US007538268B2

(12) United States Patent
Marcus

(10) Patent No.: US 7,538,268 B2
(45) Date of Patent: May 26, 2009

(54) KEYS FOR MUSICAL INSTRUMENTS AND MUSICAL METHODS

(76) Inventor: Dwight Marcus, 183 Avenida De La Entrada, Ojai, CA (US) 93023

( * ) Notice: Subject to any disclaimer, the term of this patent is extended or adjusted under 35 U.S.C. 154(b) by 738 days.

(21) Appl. No.: 10/312,771

(22) PCT Filed: Jul. 2, 2001

(86) PCT No.: PCT/US01/21182

§ 371 (c)(1),
(2), (4) Date: Jun. 20, 2003

(87) PCT Pub. No.: WO02/03373

PCT Pub. Date: Jan. 10, 2002

(65) Prior Publication Data

US 2004/0007116 A1 Jan. 15, 2004

Related U.S. Application Data

(60) Provisional application No. 60/215,417, filed on Jun. 30, 2000.

(51) Int. Cl.
*G10H 3/00* (2006.01)

(52) U.S. Cl. ..... 84/723; 84/725; 84/726; 84/744; 84/745; 84/174

(58) Field of Classification Search ..... None
See application file for complete search history.

(56) References Cited

U.S. PATENT DOCUMENTS

| | | | | | |
|---|---|---|---|---|---|
| 1,853,630 | A | | 4/1932 | Martenot | |
| 4,498,365 | A | | 2/1985 | Tripp et al. | |
| 4,649,784 | A | * | 3/1987 | Fulks et al. | 84/690 |
| 5,495,074 | A | | 2/1996 | Kondo et al. | |
| 5,719,347 | A | * | 2/1998 | Masubuchi et al. | 84/687 |
| 5,763,799 | A | * | 6/1998 | Kimble | 84/433 |
| 5,824,938 | A | * | 10/1998 | Costello et al. | 84/687 |
| 5,844,154 | A | * | 12/1998 | Kimble | 84/171 |
| 5,866,831 | A | * | 2/1999 | Kimble | 84/439 |
| 6,525,257 | B1 | * | 2/2003 | Hermann | 84/658 |
| 2001/0017075 | A1 | * | 8/2001 | Meisel | 84/216 |
| 2001/0037723 | A1 | * | 11/2001 | Nishida et al. | 84/744 |
| 2003/0183066 | A1 | * | 10/2003 | Gallitzendorfer | 84/745 |

* cited by examiner

*Primary Examiner*—Marlon T Fletcher
(74) *Attorney, Agent, or Firm*—Howard IP Law Group, PC

(57) ABSTRACT

A keyboard (25) has keys (10) mounted to pivot about a vertical axis as well as about a horizontal axis. Movement of the keys (10) about tile vertical axis is detected to adjust the sounds provided by the musical instrument resulting from striking the keys (10). Wells may be provided with a substance that is selectively solid and fluid. An electronic string instrument emulator has an electromagnetic string and a bow with ferromagnetic material. A method for performing musical instruments includes adjusting the temperament of the instrument during performance based on the music being played. A keyboard instrument may be caused to sound using suitably arrayed electromagnets.

3 Claims, 25 Drawing Sheets

KEYS FOR MUSICAL INSTRUMENTS AND MUSICAL METHODS

RELATED APPLICATIOS

This application is a U.S. national stage of PCT International Application Number PCT/US01/211,82, filed Jul. 2, 2001, claiming priority from U.S. Provisional patent application Ser. No. 60/215,443, filed Jun. 30, 2000, both of which applications are hereby incorporated by reference.

FIELD OF THE INVENTION

This invention relates to musical instrument design and modification technology.

BACKGROUND OF THE INVENTION

Musical instruments, both electronic and traditional, are capable of providing a wide variety of possible sounds. However, particularly with the development of electronic musical methods, it has become known that many more effects may in principle be achieved. The current designs of musical instruments do not lend themselves to achieving novel musical effects.

SUMMARY OF THE INVENTION

A keyboard according to the invention has keys that are capable of sensing, and integrating the control signals from, performance gestures. This is accomplished through the use of sensor configurations which sense, among other things, lateral motion about the key's vertical axis, pushing and pulling of a key in the axis perpendicular to the performer, the degree or amount of depression of the key, and bowing motions of the performer on the keys. Wells in the top surface of keys may be provided with sensors, and the information from those sensors integrated into control signals. Virtual controllers may emulate all of the foregoing effects. A method is provided for adjusting the temperament of a musical instrument, either real or virtual, in real time, effectively creating many more keys intermediate the existing keyboard.

DETAILED DESCRIPTION

Electronic Musical Keyboard and Control Devices

There are two distinct methods discussed herein for the manipulation of performance parameters. First is the use of the standard piano keyboard and control devices with the addition of structural and/or electronic modifications to the standard design. Second is the use of ancillary controllers similar to pitch wheels and ribbon-controllers, but capable of note-specific deployment as well.

Piano Keyboard Modifications

Figure 1:
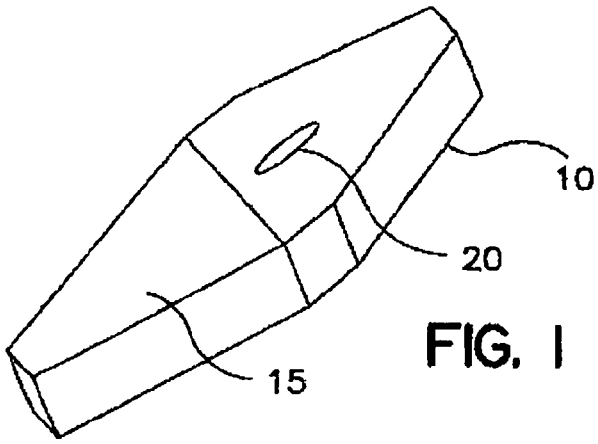
FIG. 1 is a somewhat schematic isometric view of a novel key in accordance with the invention.
Figure 2:
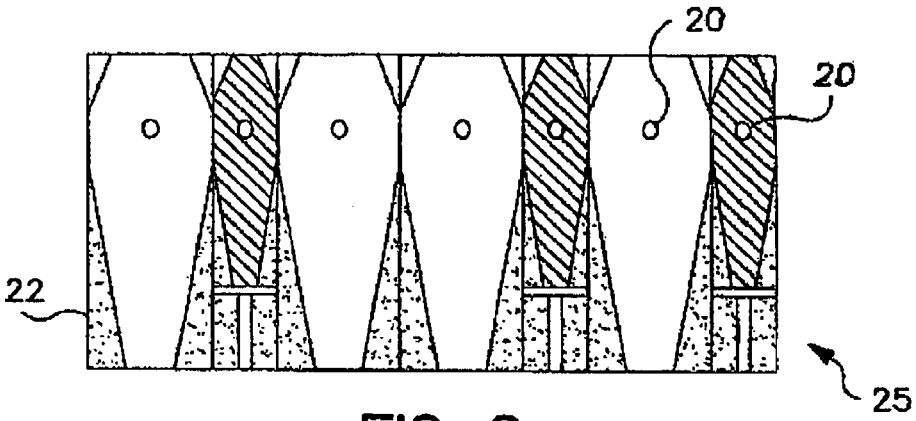
FIG. 2 is a partial top view of a keyboard in accordance with the invention.
Figure 3:
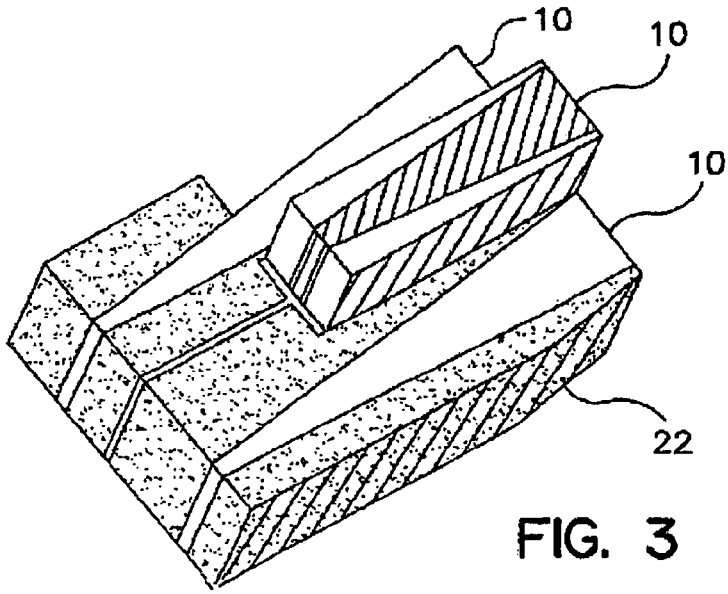
FIG. 3 is a partial isometric view of the keyboard of FIG. 2.

Referring to FIG. 1, there is shown a key 10 adapted for mounting to rotate about a vertical axis when installed in a keyboard, as shown installed in keyboard 25 of FIG. 2. Key 10 has a performance key top 15 that is planar and rigid and tapered at both near and far portions to provide a keystone-like shape. Keys 10 are allowed to pivot, by mounting at fulcrum 20, to permit each key to be swung in performance side-to-side or about a vertical axis orthogonal to the plane of the keyboard 25. Keys 10 of course pivot about a horizontal axis in the conventional manner as well. The wedge-shaped area missing from each edge of key 10 can be replaced, for instance, with a compressible material 22 as shown in FIGS. 2 and 3. The purpose of this material is to maintain the key-top area in keyboard 25 familiar to keyboardists. The compressible material Pecan be engineered to exhibit easy, low-pressure compressibility-laterally, while maintaining relative rigidity vertically, thus maintaining the feel of a firm playing surface.

Figure 4:
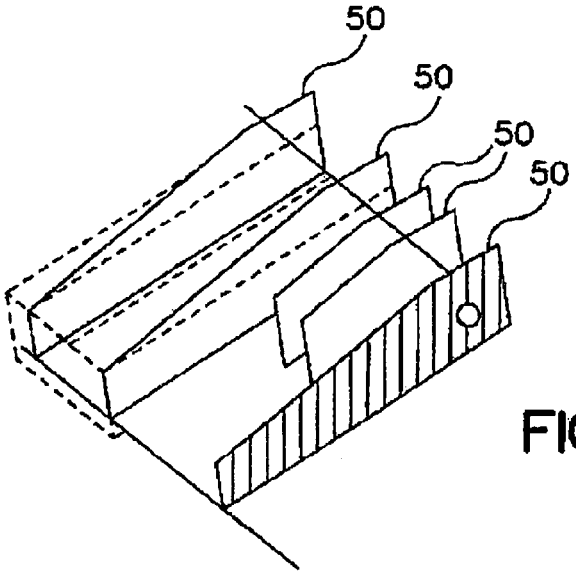
FIG. 4 is a partial isometric schematic view of the keyboard of FIG. 3.
Figure 5:
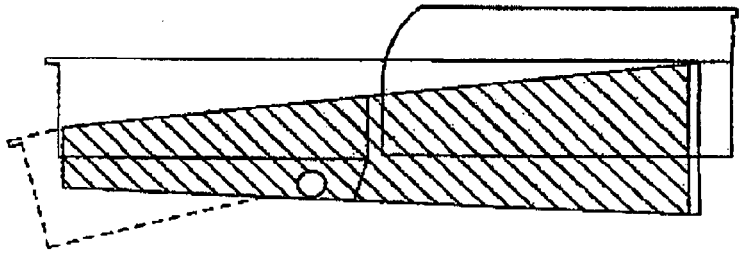
FIG. 5 is a partial side view of the keyboard of FIG. 2.
Figure 6:
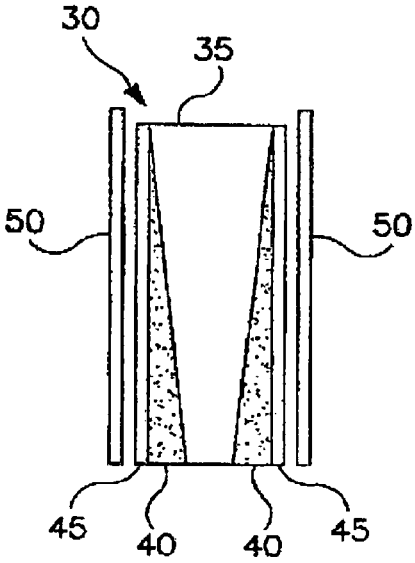
FIG. 6 is a top view of the keyboard of FIG. 2.
Figure 7:
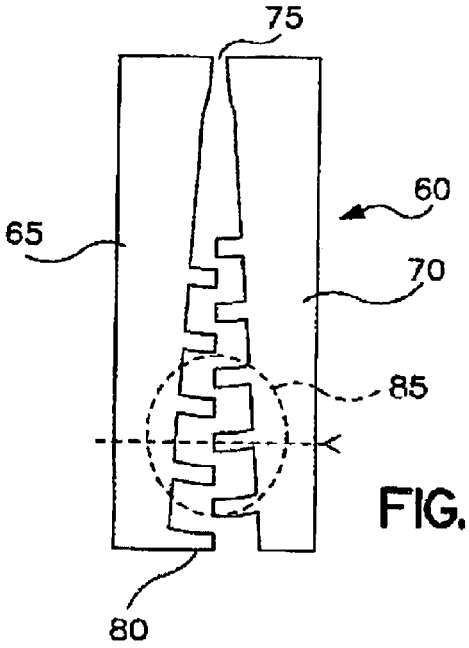
FIG. 7 is a top view of a key in accordance with the invention.
Figure 10:
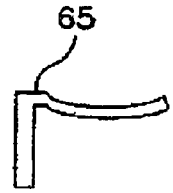
FIG. 10 is a front view of a device according to the invention.
Figure 11:
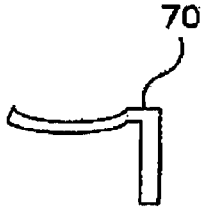
FIG. 11 is a front view of a device according to the invention.
Figure 9:
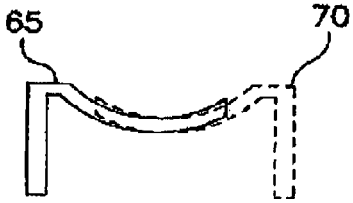
FIG. 9 is a partial front view of the key of FIG. 7.
Figure 8:
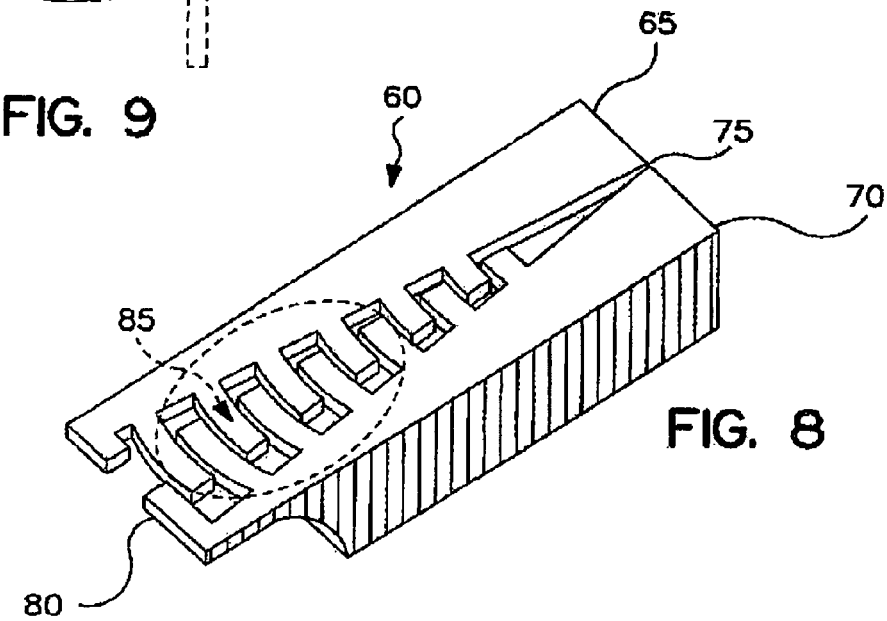
FIG. 8 is an isometric view of the key of FIG. 7.

Alternately, referring now to FIGS. 4-6, there are depicted keys 30 made of a sandwich of a center piece 35 of a rigid material and two compressible, or hinged, wedge sides 40. Key barriers 50 are depicted in FIGS. 4-6. The purpose of the barriers 50 is to prevent friction-induced interaction between adjacent keys as they are forced side-to-side. A low-friction material 45, placed on the sides of the keys 30, which material may be Teflon®, would eliminate the need for key barriers, or may be used in conjunction with key barriers. The outside surface of the compressible material 40 is preferably lined with a solid sheet 45 to prevent the rubbing of adjacent keys during side-to-side movement above the line of the keyguards 50. The keyguard 50 profile must be below the level of the depressed key, as shown in FIG. 5, to avoid interference with playing. In another implementation, the rigid part of the key 10 contains the barrier-edges as a part of the key itself. As is evident, the keystone shape of the key top is optional. The center piece hinges at the rear, and could also be bound with a flexible piece, rather than hinged. A compressible micro-honeycomb may be provided to provide a rigid playing surface while allowing the center portion of the key to swing freely side-to-side. To maintain a proper playing surface feel, a variety of design schemes might be employed. Typical of these would be to coat the key-top with a glossy expandable sheet made of stretchable plastic that would cover the key top and shrink to absorb the compression of the key wedges in performance, while maintaining a smooth surface.

Referring now to FIGS. 7-11, there is depicted an alternate embodiment of the keystone-key shape. Key 60 has two separate halves 65, 70. Each half 65, 70 tapers from the hinge point 75 to the front of the key. Protrusions 80 extend from the inner side of each key half 65, 70. Protrusions 80 define a central key well 85, the outline of which is shown in broken lines in FIGS. 7 and 8. The upper surface of protrusions 80 can be curved across the area of the key-well 80, as shown, for example, in the front views of the key halves 65, 70 in FIGS. 9, 10 and 11 to engage the left or right pull of the finger in such a way that the opposing key-half is drawn to the center of the key rather than forced outward against a neighboring key. In this implementation, sensing of the degree of side-to-side flexion might be performed internally to the key itself. That is, sensors (not shown) may be provided might sense the closure of the gap between the key halves 65, 70, and the direction of that closure. As will be described in the following section, the key-top might be fitted with an elastic, smooth surface to hide these internal geometries from a performer's fingers and to selectively decrease or increase friction over the key-top-regions.

Figure 12:
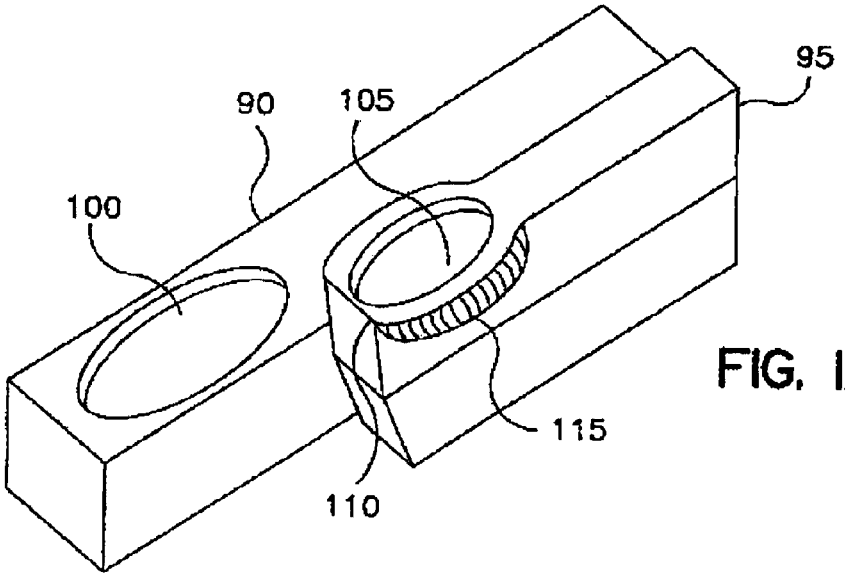
FIG. 12 is an isometric view of a key according to the invention.
Figure 13:
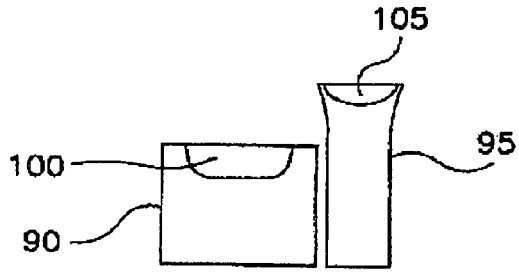
FIG. 13 is a front view of the key of FIG. 12.

Referring now to FIGS. 12-13, there are shown keys 90, 95 with shallow wells 100, 105 defined in the center of the otherwise planar key top playing surface. The front edge 110 and top 115 of the playing surface of the black keys 95 in order to enhance the effectiveness of the control afforded by the key well 105. In practice, wells 100, 105 may be filled with a rubber-like compound or other high-friction deformable material to reduce the depth of the well making it even with the key-top under normal playing key-pressures, but to allow added 'grip' by deformation when depressed vigorously. It is important to mention that the mere presence of a higher-friction rubber-like pad or any abrasive or sticky surface (with or without a significant 'well' depression, or on a flat keytop) may suffice to force the key sideways. Additionally, the material that fills or covers these wells may be engineered to respond abruptly, or under master control only, to various playing conditions.

Figure 14:
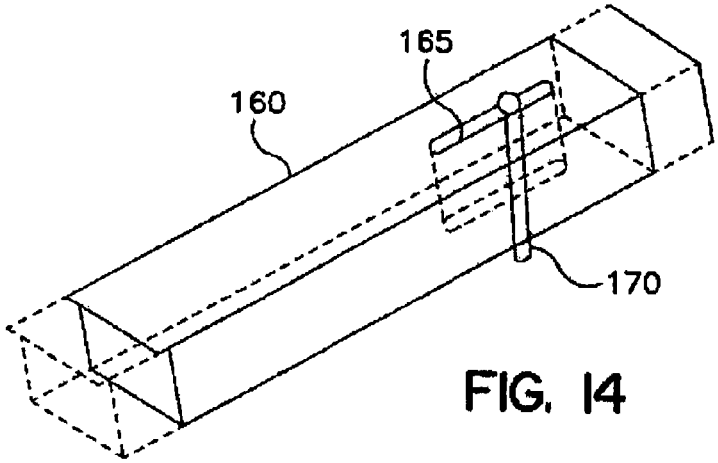
FIG. 14 is an isometric schematic view of a device according to the invention.
Figure 15:
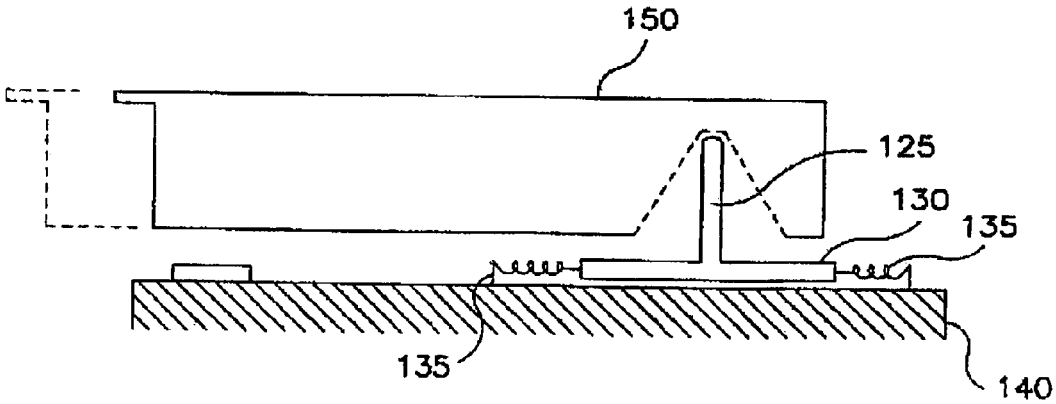
FIG. 15 is a cross section of the device of FIG. 14.

Referring to FIGS. 14-15, there is depicted a key that may be extended toward the player or pushed back away from the player. Any of several hinge strategies might be employed to allow this motion. The key itself might telescope. As shown in FIG. 15, fulcrum pin 125 is mounted on mount 130, which is slidably movable on base 140 toward and away from the player. Springs 135, or other means for applying tension, are provided to hold mount 130 in a selected rest position. Key 150 is therefore movable, as shown by the phantom lines and arrow. Referring to FIG. 14, key 160 has a slot 165 therein to receive fulcrum pin 170, so that key 160 may move toward and away from the player. Other equivalent structures may also be used.

Figure 16:
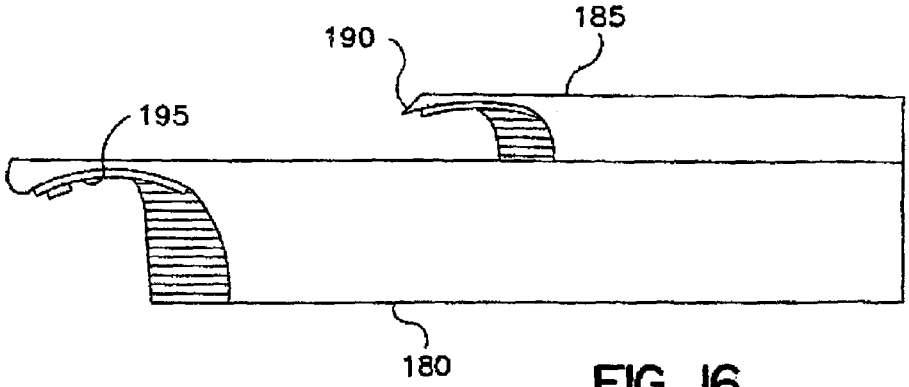
FIG. 16 is an isometric view of a key according to the invention.
Figure 17:
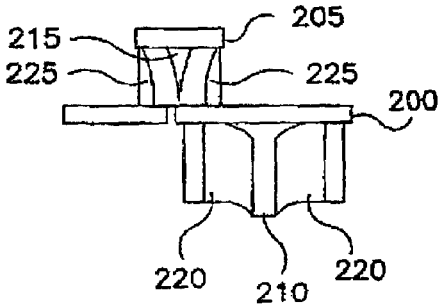
FIG. 17 is a front view of the key of FIG. 16.
Figure 18:
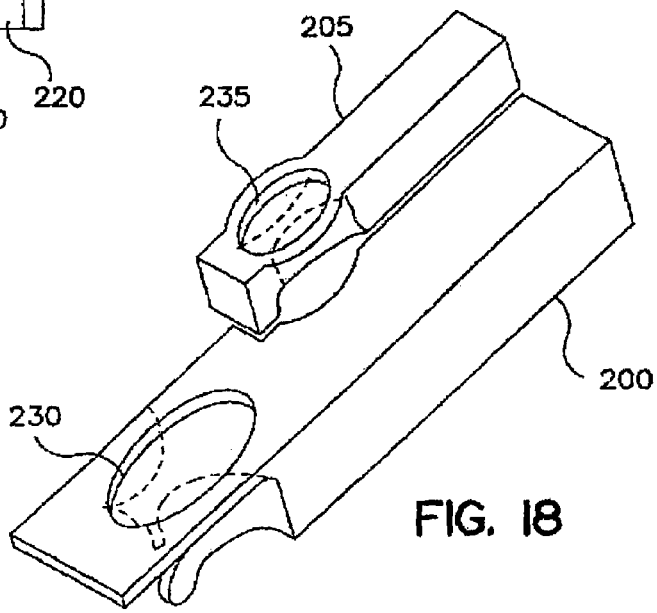
FIG. 18 is an isometric view of the key of FIG. 16.

Referring now to FIGS. 16-17, to aid the performer in this forward-sliding maneuver, the key may be modified in its cross-sectional profile. Keys 180,-185 have an arcuate forward surface below the top playing surface, defining a surface for a gripping pad 190, 195. In an alternative embodiment, shown in FIGS. 17 and 18, the keys 200, 205 have, at a forward surface beneath a keytop, a central vertical ridge 210, 215, with arcuate surfaces 220, 225 recessed on either side of ridges 210, 215. Keys 200, 205 also feature key wells 230, 235, as shown in FIG. 18. This profile, in conjunction with the use of a key-well, or high-friction portion of the keytop, allows multi-dimensional manipulation of the keys. This modification also allows the key to be pulled upward from the normal plane of the keyboard. This upward motion serves as a control gesture when used with the temperament system and method set forth below.

Figure 19:
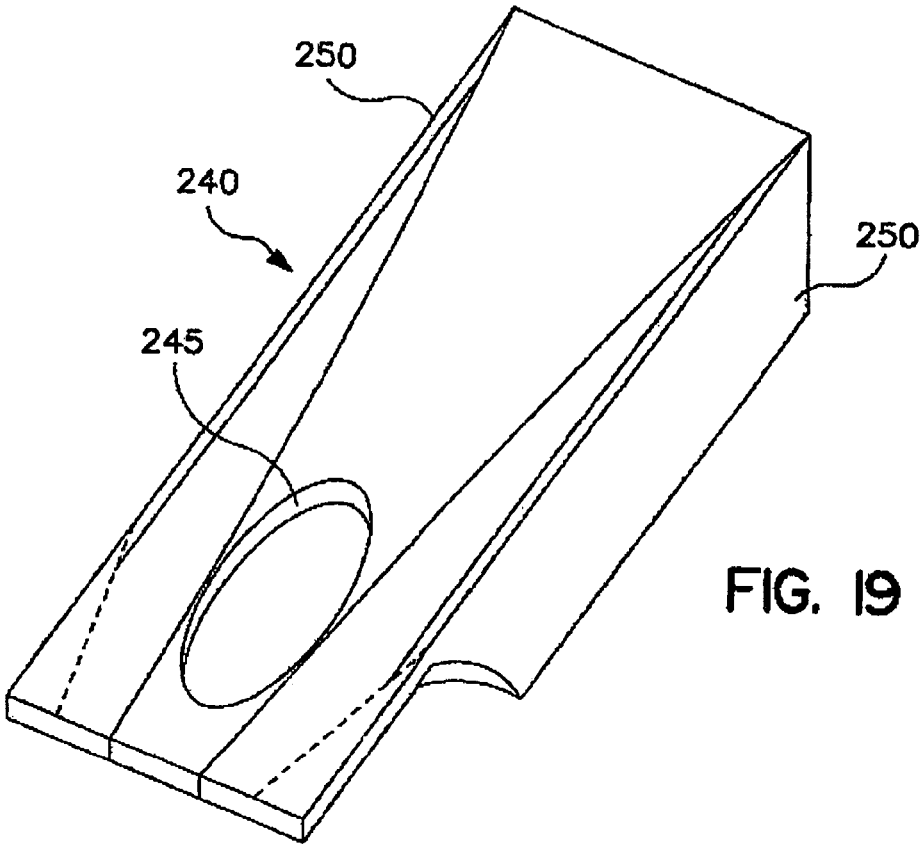
FIG. 19 is an isometric view of a key according to the invention.
Figure 20:
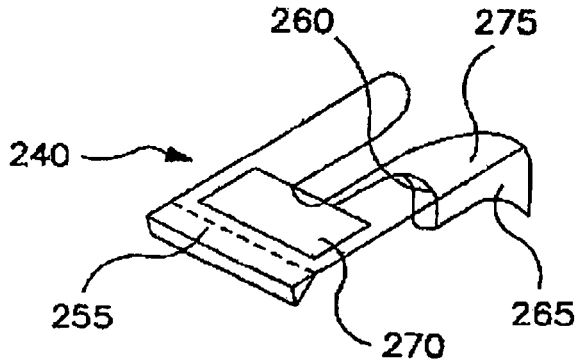
FIG. 20 is a schematic view of part of the key of FIG. 19.

Referring now to FIGS. 19-20, a further alternative key profile is shown. In particular, key 240 has key well 245 in the forward center of its key top, and slip plates 250 along the sides thereof. As shown in FIG. 20, beneath the forward portion of top surface 255, a recessed grip is provided featuring a central ridge 260 tapering downward with a concave surface, and recesses 265 on each side thereof forming concave surfaces for receiving a finger of the player. High-fiction grip pads 270, 275, may be provided both on the forward portion of key top 255 and in recesses 265. Note that small adjustments desirable to accommodate the physical implementation of this design are not pictured. These adjustments may include a rounding of the outside rear edges of the key tops to allow free pivoting around the hinge-point and a slight added depression of the key-tops around the front-edges of the black keys to allow for a comfortable depression of such a widened top. While key wedges and key-splits are depicted on the white keys, these innovations will also be applied to the black keys in actual practice.

A further possibility is to fabricate the individual keys in such a way as to allow the tips of the keys to be bent independently of the main key-body. Such distortion of the key can be restricted, or permitted, using various methodologies such as those described below with respect to the key-wells.

Each of the proposed modifications of the physical nature of the keys allows a new, and indefinite, performance parameter to be imposed upon the key's resultant musical expression. In an electronic implementation, there are no restrictions on the nature of those parameters. Nonetheless, certain control-vectors may be more intuitive to users. We will briefly investigate each control parameter.

Figure 21:
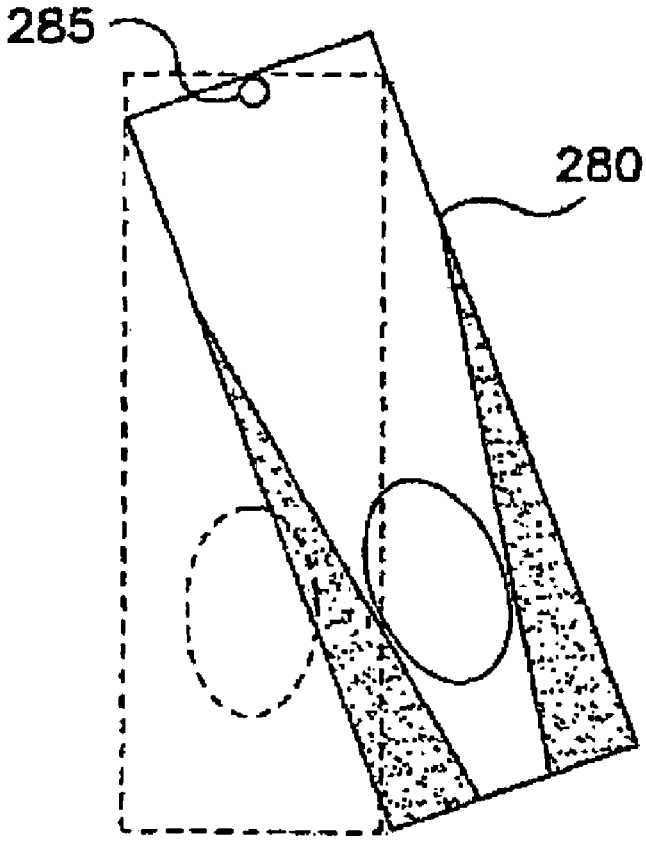
FIG. 21 is a somewhat schematic view of a key in accordance with the invention.

A key 280 may be pushed side-to-side axially from the rear fulcrum 285 of the key, as in FIG. 21, between the resting key position shown in dashed lines and the exaggerated axially rotated position shown in solid lines. Motions to the player's right create upward pitch-bends and motions to the left create downward pitch-bends, for example. This is accomplished, for example, in an electronic keyboard, by providing sensors to detect the presence, direction and amount of pivoting, and by suitable programming of the electronic keyboard or other electronic musical instrument to provide the modified pitch. In the case of mediated, derived control signals as set forth below, the actual control signal is a complex of the individual outputs of the sensors.

When a key may be drawn toward the player as in FIGS. 14-15 this motion might be suggestive of an harmonic-characteristic alteration, such as that produced by the variation of striking or picking (plectrum) distance from the anchored end of a vibrating string. Alternately, such a motion, and its inverse—the pushing of a key away from the body of the performer—is suggestive of a bowing motion, like that employed by string-players. As described below, a performer may choose the act of striking a key to result in no sound, with the key sounding only when the key is drawn toward or pushed away from the player, as in a bowing motion.

Figure 22:
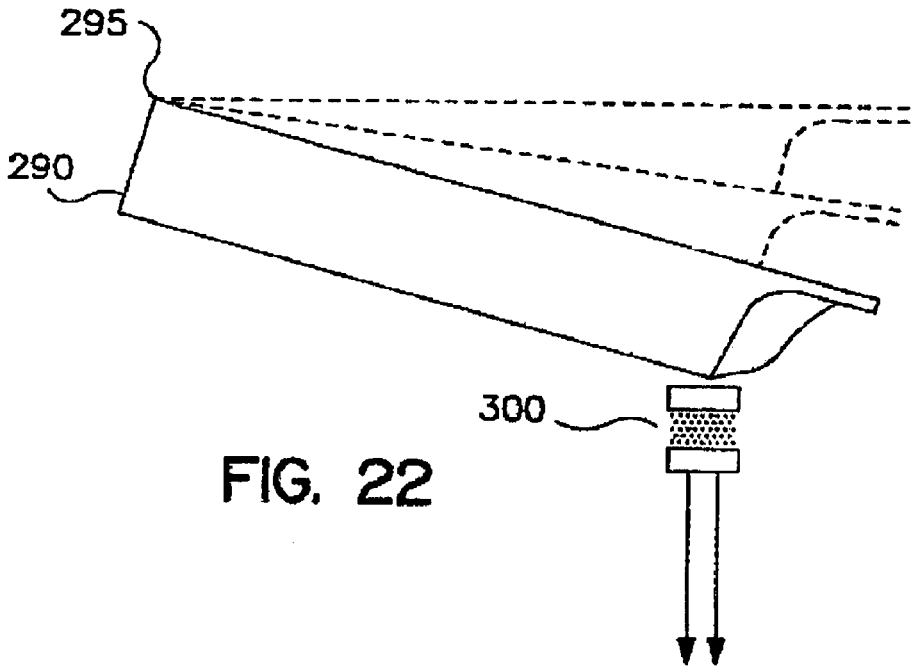
FIG. 22 is a somewhat schematic view of a device according to the invention.
Figure 23:
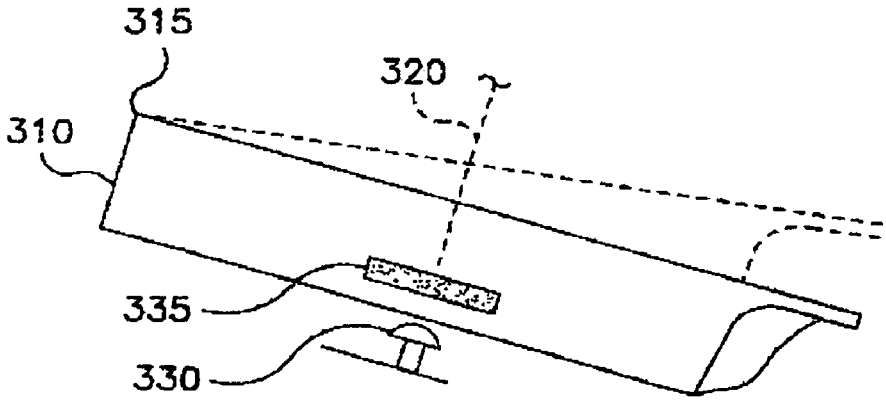
FIG. 23 is a somewhat schematic view of a device according to the invention.

A key depressed beyond its normal playing range, or torqued around an axis central to the key body, shown in FIGS. 22-23 is shown in two variants, both utilizing sensors of pressure or deformation, or gap-distance. In FIG. 22, the key 290, is shown in an extreme rotation. The phantom positions of the key represent rest position and normal fully-depressed position, respectively, when rotated about hinge point 295. In extreme rotation, key 290 strikes a firm pad 300 that will sense only extreme pressures greater than normal playing pressures, or a sensor and related electronics may be configured to provide a response only to extreme pressures greater than normal playing pressures. In the other, the key is capable of slight deformation. This deformation may be purely axial, or (as shown in FIG. 23) it might be engendered by a 'stop' 330 placed in roughly mid-key with respect to key 310 being rotated about hinge point 315. This causes deformation about axis 320, which can be detected by pressure/deformation sensor located within or on the surface of key 310. In each case, the after-touch style sensing is unique to the individual key. A data-conserving MIDI strategy will be discussed below. These motions are also suggestive of a timbral variation developing after the onset of the sound activated by the initial depression, or 'drawing-out', of a key. The entire subassembly of key, fulcrum and sensors can also be permitted to slide with the key. The global key motions are best captured by permitting the sensors to move with the key. Lateral swing sensors, likely mounted at the rear of the key behind the fulcrum can be mounted on vertical extensions of a sliding mounting sheet. It will also be appreciated that sensors to detect the degree of depression of a key, with use of that data by the control logic of a mediating layer as described below, may be provided.

Because the action of raising a key is contrary to the action that typically produces a tone, one intuitive use of the key-raising motion would work in conjunction with the sostenuto (sustain) pedal. The lifting of a key after the depression of a key, but under a sustain pedal, would imply the alteration of the tonal, spatial or spectral content of the generated note. The lifting of a key without the prior depression of that key might imply a control function. Such a function might be local or global in nature, but would typically not generate an audible pitch on its own. One suggestion is that, when employed by an instrument fitted with some adjustable temperament such as Floating Just Temperament (as discussed below), the lifting motion of the key defines the new key-center, hence the tonal center of the temperament. For example, lifting an 'A' would generate the optimized temperament for the key of 'A'. Another novel and intuitive use of the lift function would be to broaden or narrow the harmonic center of the note employed—a single pitch could be broadened into a pink-noise cluster centered around that note as the key was raised. Individual pitches are regarded as resonant events centered around the pitch-center of each fundamental of harmonic of the sounded note. Only with FJT do all of the notes and harmonics of a harmonic mass comprised of two or more notes become interrelated as multiples of a single, fundamental, pitch, if so desired.

Figure 24:
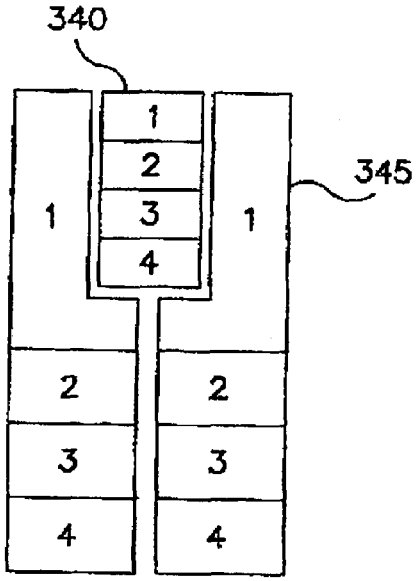
FIG. 24 is a schematic view of the keytop sensors of a device according to the invention.
Figure 25:
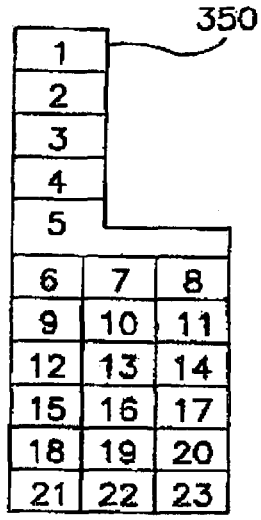
FIG. 25 is a schematic view of the keytop sensors of a device according to the invention.

Another unique control parameter that might be employed in conjunction with, or without, the above-described control elements is the use of a region-sensitive keytops. Pressure, conductivity, heat or other sensor-devices are placed in zones across the top of the keyboard. A possible low-density configuration is indicated in FIG. 24, with black key 340 and white keys 345 each divided into four exemplary zones. A possible higher-density configuration of sensors is illustrated in FIG. 25, with white key 350 having 23 exemplary zones. Note that both x and y dimensions can be addressed. Possible intuitive uses of this parameter are timbral variants produced by localized physical contact such as harmonic-generation or fundamental-suppression in stringed instruments tonguing in brass instruments, and regional-pressure effects in reed instruments. Additionally, the use of regions with percussion synthesis allows for the nuanced variation of generated sounds by emulating the strike-position on a key-by-key basis. Although the spacing of the zones is shown schematically as relatively uniform, in practice the dominant strike area of the keytop should be populated with adequate sensor or zone density to form an adequate image of the striking shape and pressures of the performer's finger. In the use of key wells or knobs as described below, the zones covering the areas of those devices remain intact, at least as on-off switches.

Each of these implementations is exemplary, and many other possibilities are desirable and easily implemented within the spirit of the invention.

Figure 26:
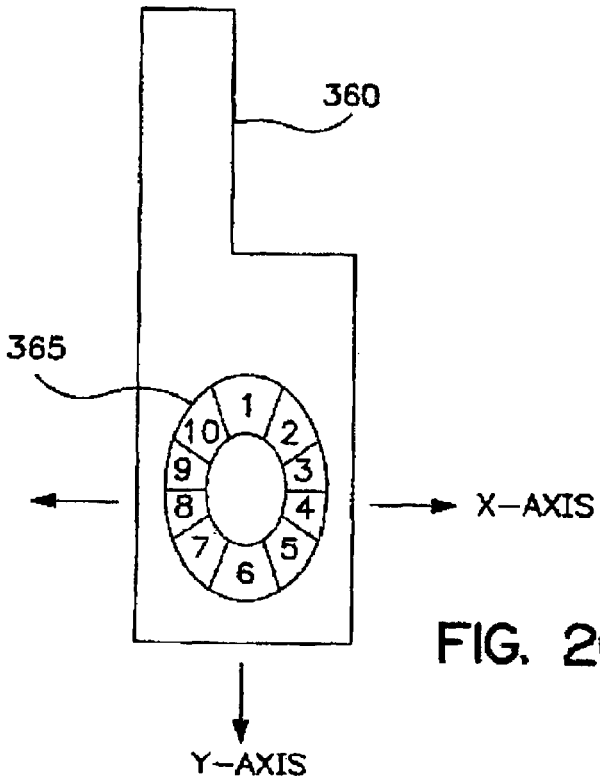
FIG. 26 is a schematic view of a well sensor according to the invention.

In one particular implementation worthy of separate discussion, special attention is paid to the issue of vibrato and tremolo as expressive pitch and amplitude parameters with special requirements. First, let's define the x-axis as that axis running parallel to the performer and the y-axis as perpendicular to the performer, as shown in FIG. 26. Using the key-well 365 of key 360 as a gripping point, small side-to-side motions, which are intuitive to performers, can be translated into small pitch variations. For example, motions to the player's right would increase frequency slightly and left-motions would decrease frequency. Also by way of example, motions toward the player's body would decrease volume, while motions away from the player's body would increase volume. By way of further example, the sliding motions in the y-axis might emulate bowing motions with a general correspondence between speed and/or pressure in either direction and volume and/or timbre. These alterations of pitch and amplitude are slight and take the native pitch and performed-volume of the note sounded by a given key as the baseline about which these parameters are varied. Second, it is desirable to define a separate region of action and detection for these expressive nuances from the larger, and typically longer-lasting expressive motions such as pitch bend and phrase-volume. This means that small finger motions, especially reciprocating motions can be sensed and/or logically separated from the larger commands. One way of doing this is to embed lateral sensors in the walls of the key-well, as shown in the ten regions shown in FIG. 26. This can easily be accomplished with any number of pressure-sensing transducer arrangements, or through the varying capacitance or conductance characteristics of the well-filling material itself. Another possibility is to embed audio transducers that are sensitive in the two to ten Hertz range within the x- and y-axes of the well walls. These transducers, or other pressure or motion sensors, could be high-pass filtered to reject very-low frequency input, or be made to inhibit their output when similar larger-scale signals were generated by the grosser key-movements detected by the motions of the key-body itself. With this structure, identical axes of motion can be sensed in alternate ways in order to derive two different families of control-signals. Even if sensing were performed by the same transducers, it is significant to separate short time-duration and small amplitude variations into a separate, unique control-signal for the purposes of addressing subtle nuances of phrasing, rather than more significant shifts such as portamento and timbral shifts. In this way, the same key motion can generate very different, but intuitively-related control parameters.

Figure 27:
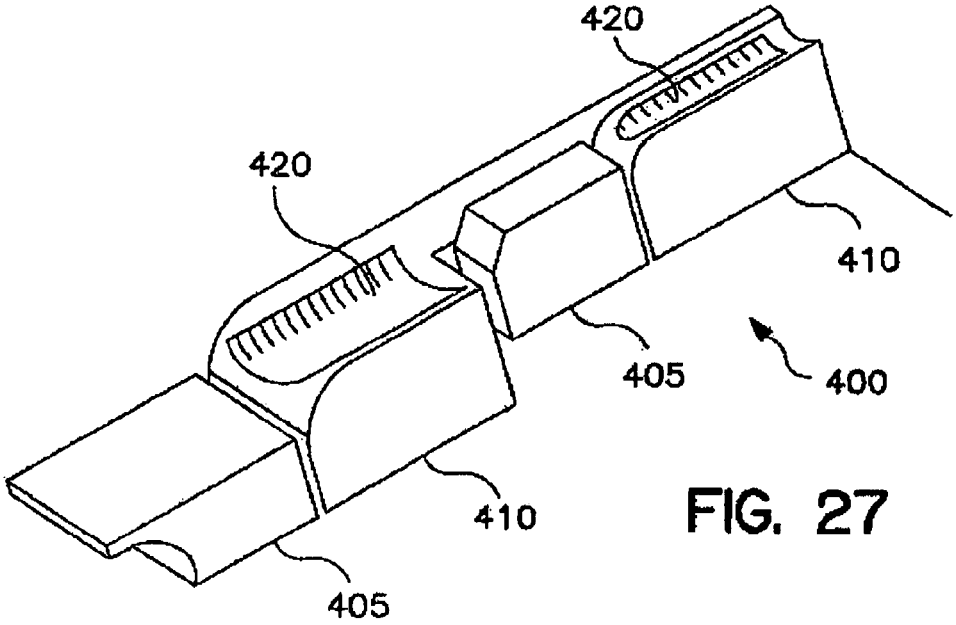
FIG. 27 is a somewhat schematic view of a key according to the invention.
Figure 28:
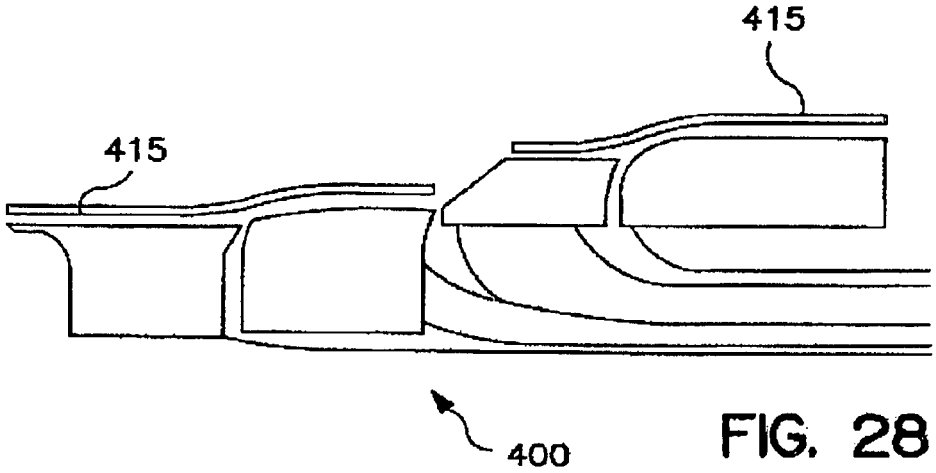
FIG. 28 is a somewhat schematic side view of the key of FIG. 27.

Another implementation of keyboard control-parameters that is particularly suited to the implementation of pitch-bends—especially in an acoustic-mechanical realization—is the system shown in FIGS. 27-28. Here the key 400 is split into two parts. The area closest to the performer might be designated the 'strike' area 405, and the area of the key further from the performer might be the control area 410, which we will call here the 'bend' area. This implementation can be combined with any of the other modifications outlined here, such as key-wells and side-to-side bends. The key thus splits, allows multiple uses of fingering techniques to activate the key. The key might be covered with an elastic surface 415 spanning the physical divide of the key-top. This elastic covering 415 would be desirable in a design-implementation in which the bend portion 410 of each of the white or black keys would be drawn downward along with the strike portion 415 of the keys. This could be accomplished by interlocking the key profiles in a number of ways. A keyboard made up of keys 400 could, for example, be played in the traditional manner on the strike portion 405 of the keys 400. By sliding the finger smoothly away from the strike portion 405 onto the bend portion 410, a smooth entry into a pitch bend could be accomplished. Also pictured in FIGS. 27 and 28 is the use of key wells 420 solely on the bend portions 410 of the keys to provide the player additional control over the selection. Such a split key could also be formed in three parts, where the central part of the key is attached to the conventional vertical hinge, and the split sides of the keys hinge laterally from that central member. In this arrangement, the vanes depicted would be over this central member such that the central member is shielded from the performer's touch.

In summary, central or key-well depression can be separately processed for internal sensing applications only and not merely to communicate larger motions to the keys themselves. In this way the central motions of the key are optimized to 'look' for expressive nuances while the larger key motions are for definitive pitch-bending and other large phrasing effects. This may be done by floating the well within the larger key body. Sensors of various types measure the distance, pressure and positional relationship in any desired axis of the well element to the body. Highly-mobile, low-reluctance linkages capable of swift movements to the key-body combined with high-reluctance, low mobility linkages capable of slower movements would act as a mechanical filtration system aiding in the electronic differentiation of gestures. There is then an implied HP-filtering that occurs within the key-top and a concurrent LP-filtration in the sensing motions of the global key as a whole. This illuminates an interesting refinement in the consideration of key-sensing for gestural nuances.

Figure 29:
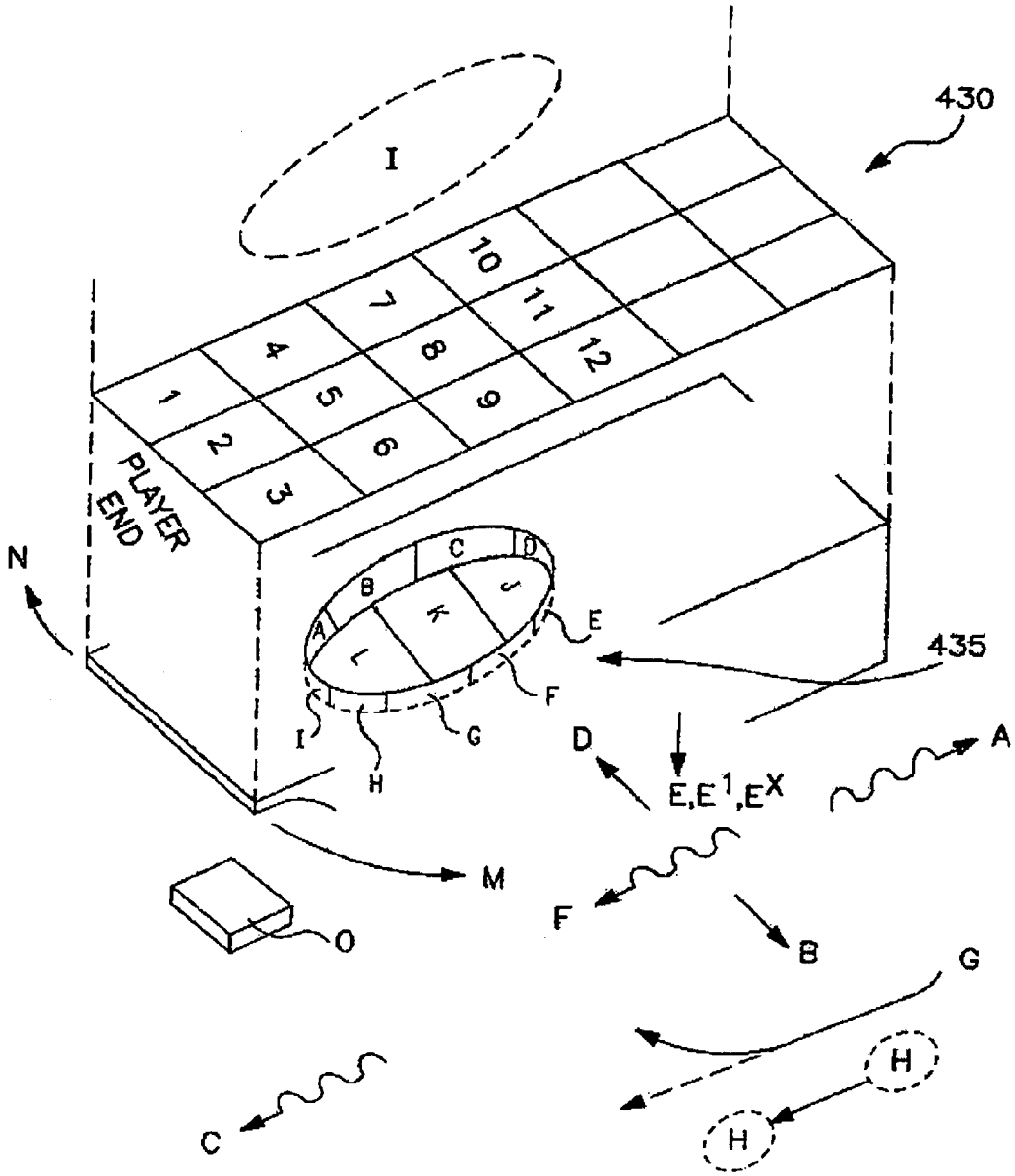
FIG. 29 is a schematic view of keytop zones according to the invention.
Figure 31:
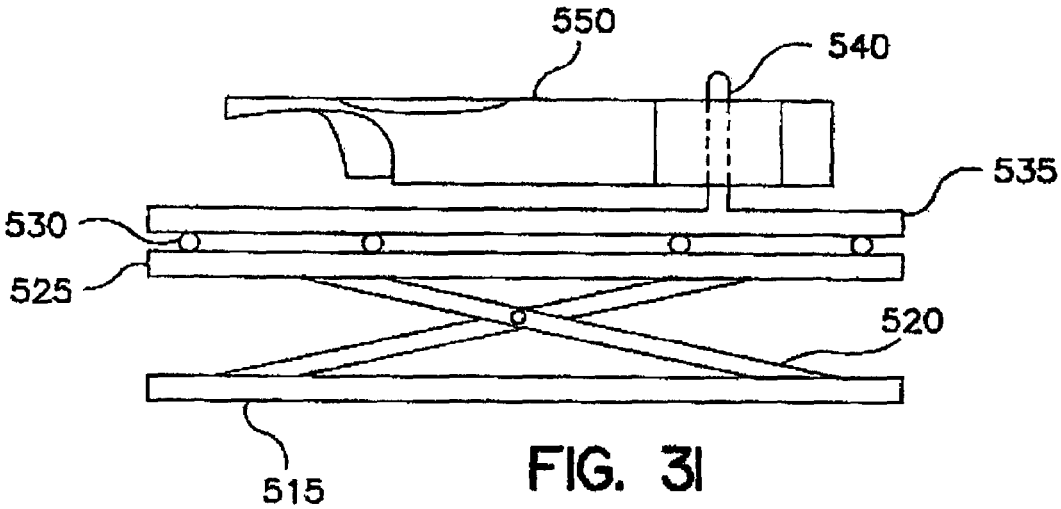
FIG. 31 is a side view with partial cross-section of the controller of FIG. 30.

Referring now to FIG. 29, in a brief consideration of novel 'gestural sensing', pictured in FIGS. I-3, the following exemplary practical gestures may be employed with respect to key 430 having well 435. Lettered zones are in the well, and may have the following results on the sound:

A/ away from performer—perhaps less attack or muted tone, or tremolo, or bow position emulation B/ to left of performer—perhaps simplified voice waveform or slow Doppler, or strum emulation, or one-phase of vibrato C/ toward performer—perhaps brighter attack, col legno, tremolo or bow position emulation D/ to right of performer—perhaps more complex or grouped/chorused voice/waveform, strum emulation, or one phase of vibrato E, $E^{1-X}$/ straight-down—perhaps cancellation of fundamental or enhanced harmonic-generation or phantom-note F/ finger-motion within channel/key-top—any number of possible uses, a derived vector or complex for plectrum/bow motion, movement in space, or complex chorus/vibrato G/ upward sweep—perhaps a derived vector for say 'gliss-up'

H/ flattened finger—a derived vector for, perhaps, slow bow-speed, an emotional quality like 'gently' or, in the case of percussive sounds, a wider/softer mallet I/ laid-out finger—a derived control-vector for perhaps a second voice or broader tone, or simply an extension of the mallet-like qualities of H The concept of 'phantom-notes' and other derived 'phantom' elements will be taken-up later. This concept in itself is of great significance within the proposed system. What is discussed here is the concept that notes can be 'played' on the above-described modified keyboard in such a way that the derived-control vector of such playing (whether or not the actual gesture described above engenders it) yields note information that is not sounded. Thus a note can be 'teased' out of the keyboard without sounding an audible tone, perhaps even by the simple act of an extremely light or slow depression of the whole key itself or by a newly-defined gesture such as key-lifting. This 'phantom' note will then be routed to become a controlling element of some portion of the FJT strategy. These precise strategies will be described later.

In summary, control signals are derived through a filter and sensor-array designed to isolate and derive intelligent control-vectors. Consider also that keytop sensors might combine with well-edge and bottom sensors, as shown in FIG. 29, in an array enabling the derivation of gestural nuances such as the flatness of a finger-strike or the wiggling of a finger across the keytop—gestures which might be quite separate from the grosser key-motions and velocities and pressures. This is especially true if the key is able to divide into a simple strike-region and a nuance-region. This divide can also be actively derived so that no 'hard' and fixed area-delineation has to occur on the key-top itself. The division can be provided in a virtual manner.

A key-top capable of active display of actual or intuitive parameters through the use of signifying information such as alphanumeric characters, colors, graphics and the like might make such a changeable and dynamic system more intelligible to the performer. The surface of the key would thus be capable of displaying some sort of indication of functionality across its key-tops. There are a variety of inexpensive and durable thin-profile displays available that might be adapted to this purpose. Significantly, the key-top itself, including perhaps the well, could be made transparent and an interior display could be placed below the durable surface of the key. Any of the many thin-display panels now in common use in laptops, cell-phones and the like which contain regions or pixels would serve these purposes. In a simpler implementation, such a display might reside adjacent to the keys, probably right above them on the front-panel of the keyboard, near the hinge-portion of the key.

Implementation of Key-Wells

Figure 44:
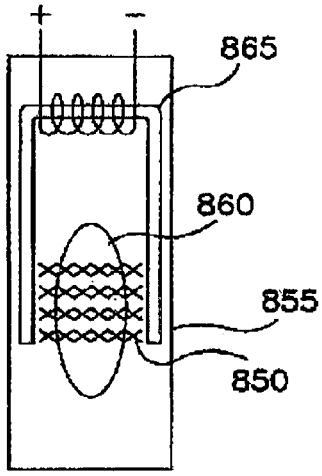
FIG. 44 is a top view of a device of the invention.
Figure 45:
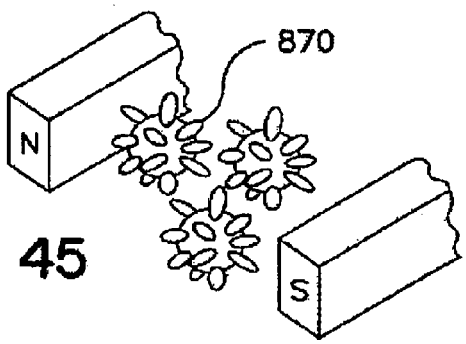
FIG. 45 is a schematic isometric view of a device of the invention.
Figure 46:
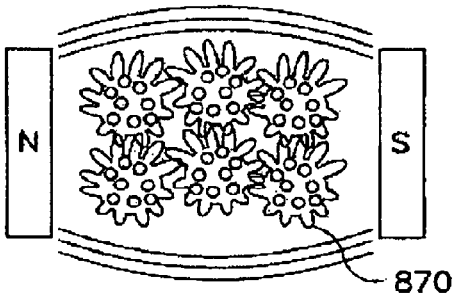
FIG. 46 is a schematic view of the device of FIG. 45.
Figure 47:
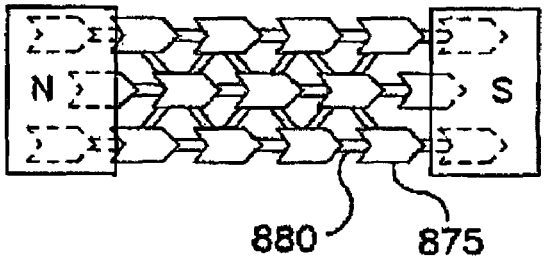
FIG. 47 is a schematic view of a device of the invention.
Figure 48:
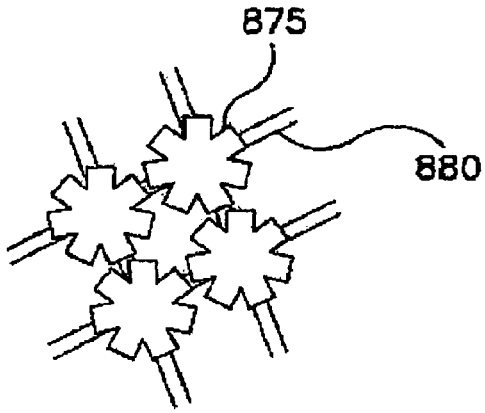
FIG. 48 is a detail of an embodiment of the device of FIG. 47.

Players may find the presence of the proposed key wells to present a slight impediment to traditional playing styles. For this reason, the following methods are discussed. A material exhibiting a non-linear response to velocity or pressure over time could be employed to cause the well to increase in depth with any of higher-than-normal playing velocity or pressure—especially when that force is sustained over time. To enhance these natural qualities, or to replace them entirely, it is possible to create a reservoir for fluid, viscous material or gas within the body of the key itself. A valve constructed with the characteristic such that the fluid or gaseous content of the well is released into that reservoir with a desirable temporal characteristic—that characteristic being generally that the sustained application of key-pressure or the sudden onset of high key pressure causes an evacuation of the well into the holding-area within the key-body. The valve will be constructed so that the removal of pressure would cause an abrupt re-filling of the well. The valve can be passive or actively activated. A well might be something like an elastic membrane covering a porous sponge filled with air or fluid from which there is a controlled, perhaps singular, exit. This exit allows the contents of the sponge and/or chamber to exit, the speed of which can be controlled as described above in such a way that pressure exceeding a certain threshold (greater than typical playing in pressure or duration). Alternately, key wells can be prevented from opening by the use of actively-controlled depression-mechanisms operated either by electronic sensors on key-tops designed to create, in conjunction with controlling electronics, similar non-linear response characteristics to those described above, or by means of globally-activated or individually-activated commands issuing from a footswitch, manual controller or musical-sequencer. Referring to FIG. 44, typical of the mechanism for the depression-controller guarding the key-well might be memory-wire embedded mesh 850 covering the well 860 in the top of key 855, with electromagnet 865 provided, or a magnetic, or charged-particle slurry or matrix such as that depicted in FIGS. 45 and 46. Referring to FIGS. 45 and 46, there are shown floating magnetizable burrs 870 between two poles of a magnet in an off condition in FIG. 45 and in an "on" condition in FIG. 46. In FIG. 46, the burrs are in a magnetized state and are aggregated to form a solid. In FIGS. 47 and 48, metal particles are woven on elastic fibers between two poles of an electromagnet. The mechanism is activated by, in the wire instance, a flow of heat-generating current and in the magnetic slurry by a flow of current through small electromagnets, where the polar-gap of said magnets is across the slurry-filled surface of the key-well. Varying strength fields, such as might be variably-applied by electromagnetic devices driven by varying current/voltage, as well as in various and multiple field-directions, polarities and shapes, might also create varying, and even fluidly varying, physical characteristics.

Several implementations are possible. In one, an array of burr-like spheres, or other interlocking or effectively-binding 'particles' are loosely clustered together. The cluster is covered with a smooth surface which is flexible and perhaps mildly elastic. Each edge of the well topography might contain the opposing poles of an electromagnet such that, upon activation of current-flow, the magnetic field of that device would be applied across the surface of the well thus causing the attraction of the 'particles' or burrs together. The resulting characteristic of these particles would approximate, under the modest pressures of musical performance, a solid surface. When the characteristics of the key-well were desired, the current-flow to the well-surface would be reduced or cut-off. This technique can be combined with the mechanical fluid-like methods described above for the appropriate 'feel' to the performer. Likewise, a substance which achieves a viscous state at modest temperatures, such as a wax, could be liquefied by sustained finger pressures or by activation of a heating mechanism (such as a resistive wire). The key to these schemes is rapid solidification and solidification times. This suggests the use of thermally-sensitive elements of low mass which are mutually interlocked by an inactive matrix of high insulation value such as low-mass plastics. Thermally-sensitive 'beads', which might be soft plastic shells filled with a low melting-point wax, are strung together on (elastic or elastically-mounted) resistive wire. The beads are insulated from one another by plastic-foam beads that interlock with the wax-filled beads to form a solid mass by interlocking when the wax is cool. Another variant of this concept would employ tiny thermocouple junctions inside each meltable-region. By reversing current flow through the thermocouple, the re-solidification process would be greatly accelerated. Having outlined all of these schemes for the enhancement of the playability of the "welled" keys, it should be noted that an appropriately viscous material backed up by a spring mechanism which has the characteristic of slow activation and rapid release will probably meet the playing requirements of most musicians.

The burrs are optionally surrounded in compressible plastic such that the burrs are free to protrude upon the application of pressure, but are hidden upon decompression. The optimal character of the encased ball is then of a nearly smooth sphere with small 'whiffle-ball-like' openings through which the burrs or studs are free to protrude. It's also ideal that the plastic casing is of a very low surface friction, such as a Teflon®.

Secondly, the 'feel' of the non-rigid surface (that is, the balls under no compression) can be improved by biasing the bearings with a spring such as that provided by a springy padded backing.

Third, the balls or bearings can be caused to maintain alignment by being situated in pits on the above-described biasing backing, or on the rear of the presenting flexible sheet that overlays the bearings to create the illusion of a continuous smooth key-top. In practice, the bearings would be molded into such a surface, or captured between the two surfaces, and the balls/bearings top-most surface would be flattened to present a smooth contour. Additionally, with or without the aforementioned refinements, the 'bearings' could be strung on fibers, wires, and the like, in the manner of beads. The stringing of the beads could be in one, two, or (in other applications) three dimensions. It should be clear that this design has uses beyond the anticipated use described here.

Shape memory alloys (SMAs) and bimetal sheets can also be employed for the purpose of generating a disappearing well. In both cases an electrical current, or other suitable method, provides a beat-source to the well's surface. The heat causes the bimetallic sheet or SMA wire mesh or sheet to deform by bending downward revealing the well. Again, biasing with backing or front pressure from springs and plastics or foams is possible. It will be discussed elsewhere but Peltier effect is worthy of mention in this regard. By placing a suitable (semiconductor) thermocouple below the bimetal or SMA surface and in contact with one side of the device, rapid shifts in heating or cooling can be accomplished. Assume that the room-temperature state of the sheet is flat. Assume that the heated state is such that a depression is formed (the well). Thus upon the sensed pressure, current would be passed through the (semiconductor Peltier effect) thermocouple in such a way as to cause rapid heating and depression of the key-top well. (The mass of the well-surface would be kept very small.) Upon the sensing of release of pressure a reverse current would be swiftly applied causing a burst of cooling to occur. Strain gauges, thermistors, thermocouple sensors and the like could also provide feedback to the cooling and heating action to maintain appropriate states in the well-top. In a variant, the key-well is maintained in a flat (no-well) disposition by suitable tensions across the surface film, or by other known methods. Below the film is a shallow pool of a substance with an ideal melting point of roughly body temperature or slightly above. A wax is one example. If the wax were to be molten, the inherent biasing of the surface would return it to a flat position, where no well could be sensed, but upon the application of finger pressure the molten wax would displace and the finger would penetrate slightly into the key-top. If this method were also enhanced by the presence of a thermocouple device capable of providing rapid heating or cooling by the simple reversal of polarity, then the well could be suitably managed. In the case of both thermocouple methods described it's necessary to provide heat and cold dissipation for the opposite electrode. A small heat-sink is provided on the underside of the key to dissipate thermal energy into the air. Remember that the well is most often energized when the key is in motion, so the added eddies around the heat-sink due to key motion should add to the efficiency of the method.

Tiered Sensors of Key-Tops

Strain and force sensors (SFS) assess force and represent it as an electrical signal. There are many known types. The surface of the key is provided with quantitative or qualitative SFS'S, or similar devices, to assess the profile of the finger's attack in zones across the surface of the key. Quantitative sensors give more accuracy and nuance to the key-top zones, as does an increased number of zones. There should be no need to provide to a synthesis, or tone-creating device, direct access to the outputs of the SFS devices. A mediating layer, as described elsewhere will likely first interpret the signals and provide an output in consideration of a blend of factors.

Figure 49:
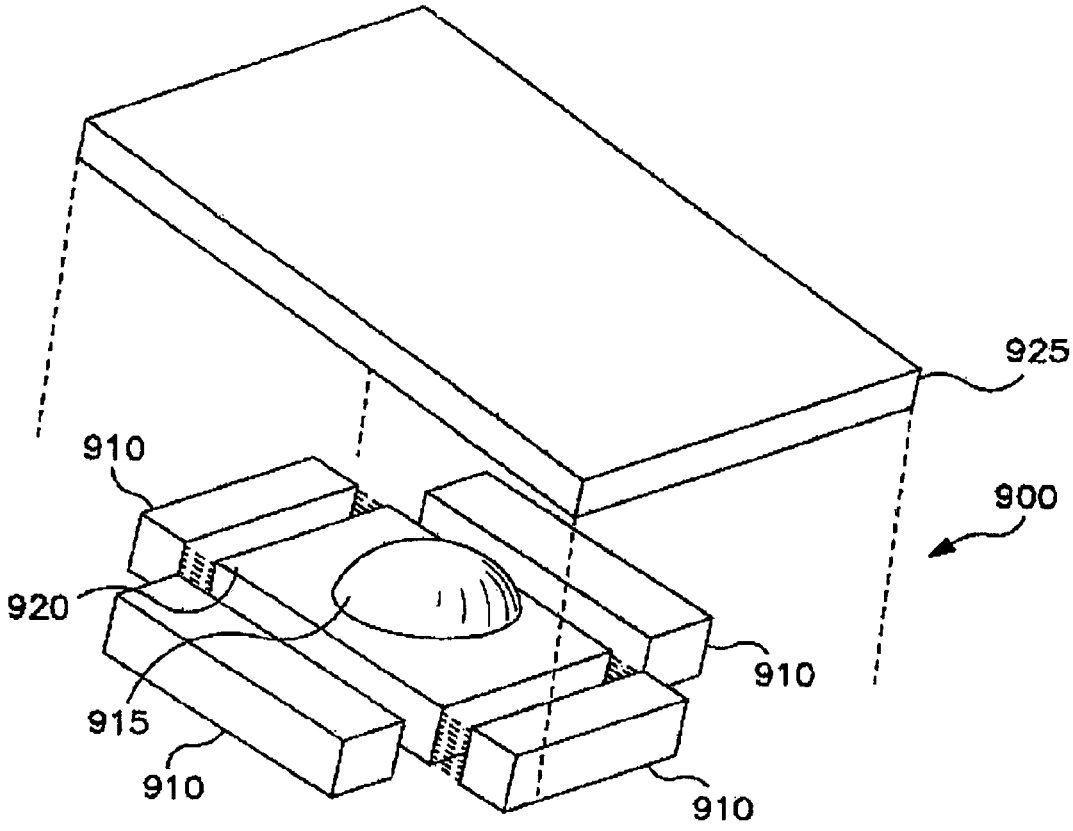
FIG. 49 is an exploded schematic view of a device of the invention.
Figure 50:
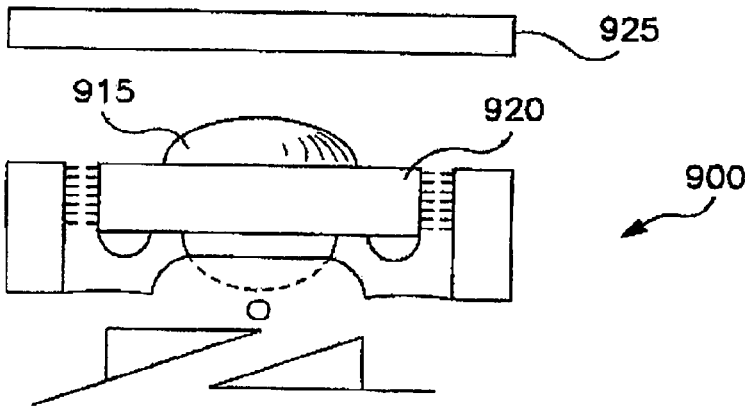
FIG. 50 is side view of the device of FIG. 49.

Referring to FIGS. 49-50, there is shown a key-top well sensor 900 in an exploded isometric view in FIG. 49 and a side view in FIG. 50. Whether or not the 'well' is real or virtual, or even raised, the sensors here are generally unconcerned with finger profile. The edges of the well can be lined with SFS devices 910. A slight lump may be introduced into the key-top. Below, or in the middle of, the zone-sensors is placed a small ball-bearing like sphere 915. The 'bearing' sits roughly halfway into a fitted well. The bearing is contained in a floating platform 920. Platform 920 may have a thermocouple base. Each side of the well, say the four equally-spaced sides (NSEW) are equipped with suitable force sensors 910, or SFS devices. The 'bearing' is now placed under a cushioning, flexible surface 925 in such a manner that the gentle lump of the bearing can be clearly felt by the fingertip upon depressing the key, but can also be ignored for traditional techniques such as glissandi. Surface 925 may be slightly compressible lubber or other polymer. If the performer so desires, the finger can gently depress into the cushioning mat 925 and engage the bearing 915 by forcing it into the fleshy mass of the fingertip. Now any gestures in any of the 360 degrees can be captured. Suitable linkages that allow range-of-motion and pressure/force linkage to an array of any number of suitably-arranged sensors to detect properties including the force, velocity, magnetic field, or degree of deflection of bearing 915. Pulling the key toward the player, for example, or urging it side-to-side can now be done. Isolation and/or integration with the (optional) key-top zone sensing can now be easily accomplished. It's immaterial whether or not the key is so formed to allow actual motion in these directions. Some range-of-motion provides useful feedback to the performer. Also, the generally longer time-frame gestures of the grosser whole-key can be suitably damped with, for example, miniature pneumatic pistons set for appropriate 'give'. Variable air-intake valves can automate the time constants of these pistons to adapt them to a given control-patch or setting, which may be different from voice to voice. Magnetic elements which make contact in the resting key position and break from each other upon the forcing of a key, for example in/out or sideways, can set the reluctance of the key to move. Thus a functional mechanical threshold is set for the onset of global key motions. Permanent magnets can preset these values, as can other forms of reluctance/threshold mechanisms, but electromagnets offer the advantage, again, of a threshold that can vary from patch to patch. Also of interest is the placement of SFS device(s) along the edge of the key to sense side-to-side motions or pressures beyond the normal playing limits. While this can in theory be done directly by the sensor arrangement described above, it represents an alternate scheme.

Figure 51:
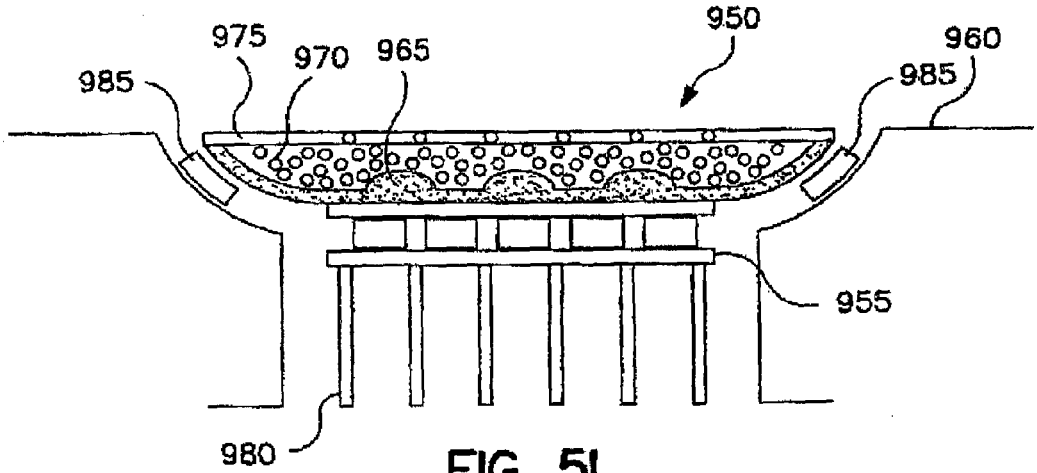
FIG. 51 is a cross-sectional view of a device of the invention.
Figure 52:
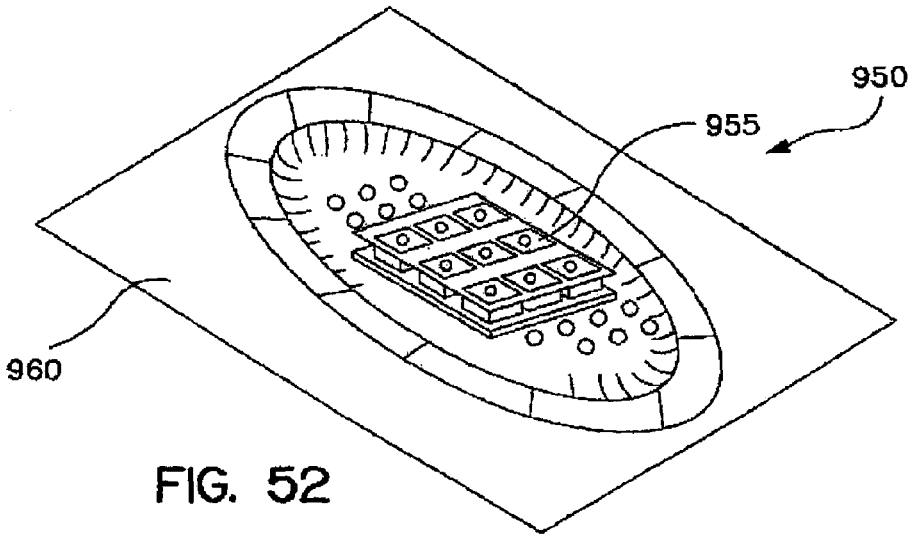
FIG. 52 is an isometric view of the device of FIG. 51.

Referring now to FIGS. 51 to 52, there is shown a key-well 950 having a Peltier thermocouple array 955 which has the capacity to both rapidly heat and cool its surfaces according to the direction of the current-flow applied to it. Well 950 is located in a recess in key body 960. The array 955 lies below a suitable textured 'gripping' surface 965, which is in turn mounted below a substance 970, such as a wax, capable of swift change at near-room/body temperature from solid to liquid. An elastically tensioned well top 975 is preferably covering substance 970 and impervious to substance 970. Energy applied selectively to the thermocouple will cause a state-change in the well-material 970. A heatsink 980 preferably extends below thermocouple 955 through the bottom of the key body. Sensors 985 are mounted on the key body exterior to the well. It is suggested that certain user-initiated controls, such as by footswitch or MIDI-signal, as well as certain gestures, such as type of attack-profile like finger-position or pressure, be optionally caused to control the palpability of the key-well.

Sensors may also be provided to detect the approach, and such characteristics as speed and direction of approach, of the performer's hand or fingers. Such sensing methods as capacitance and Doppler-shifted reflected energy, such as ultrasound, detect the general character of approach, and thus set parameters, in advance of hand contact with the keys and concomitant sounding or silence by the instrument. This sensing may be accomplished globally, and by fitting each key or key-region or adjacent area below or behind or beside individual keys with appropriate sensors such as sonic transducers and/or capacitive, inductive, or RF-profile sensors. The details of the selection of the transducers will be within the level of ordinary skill in the art. The signals from these sensors may be included among control signals used as inputs to various algorithms.

It should be noted that a key can be struck in a variety of ways. Normally, in electronic keyboards, strike pressure and after-touch pressure, that is the pressure exerted on the key after its initial sounding, can be captured. Virtuosi of the acoustic piano claim to achieve some timbral nuance by altering the strike velocity versus force ratio. While it would appear at first blush that strike velocity would be linearly related to strike force, this is not the case.

The gestures applied to keyboards by the simple act of striking a key can be analyzed by the layered sensor approach described in this patent application in an additional novel way. By sensing the force, finger-profile (strike-shape), and/or duration of the keytop-zone sensor outputs (or of the control signal from the key-well or it's raised analog) and further by comparing this signal across time with the traditional key-closure or activation signal, information can be derived regarding the specific nuances of the striking action. For example, a high strike force at the key-top followed by a modest strike force at the key-closure would indicate a rapid, low-force strike, because the inertia of the key and/or the intention of the performer caused a deceleration to occur between the two closely-spaced events.

Accordingly, we will capture both key-top and key-closure and/or key-stop (Defined as the force of the key hitting and/or pressing upon the body of the keyboard assembly and/or its range-of-motion limiting elements) force to optionally create the various characteristics of the sounded tone

- monitor the continuous pressure from various key-top sensors across the duration of the strike-event to further derive control signals useful to synthesis and tone modification
- make use of the time-difference information between key-top and key-closure and/or key-stop information to further derive control signals useful to synthesis and tone modification
- optionally employ key-top and other early control information to sound tones or otherwise vary sound outputs even without traditional key-closure or key-stop data By the above methods, used alone or in conjunction with other related methods described in the patent application (such as the sensing of finger-contact profiles), we propose to allow significant gestural nuance to be captured from the variations possible within the basic act of key-striking.

Key-Mounted Accelerometers

Additionally, accelerometers may be used within the key itself, such as mounted within the end of the key nearest to the performer, to generate additional control signal information. By capturing, for example, a particular deceleration or acceleration curve across the attack component of a sounded tone, or even prior to the sounding of the tone, exceptional gestural nuance is possible. It should be clear that the use of accelerometric data in the context of the highly-mediated control system proposed herein does not preclude the further conditioning and/or modification of the data by the additionally proposed nuance-capturing parameters.

There is potential application of heads-up display technology and the new head-mounted displays, such as see-through-lens glasses equipped with reflective head-mounted monitors. The challenge here is to sense the relative position of the performer to the keyboard, a problem that is easily solved. In this scenario an image of the actual type of mechanical control device being emulated might be superimposed on the keytop—a bow, a pick on a string, a drum-stick, a finger on a guitar-string, lips against a flute or reed, and so on.

Motional feedback may be used in connection with the musical keyboard. Progressive resistance might be applied to the player's fingers during pitch-bends to emulate the feel of a tightening string. There are numerous examples. The sliding back and forth of the modified key toward the player and away under the control of a motor might create dynamically increasing resistance as downward pressure ad bow-speed is increased, the resistance might follow the vibratory pattern of a bow on a string of that particular sounded pitch, using a simplified implementation of the bowing device described herein, for example. Even the simple feeling of a hammer, bow, finger, or plectrum being ejected by the key-strike, or hitting a string, drum or cymbal, for example, with varying degrees of force, is a novel suggestion for emulation, which when combined with, say, a sense of after-touch pressure against the string (or other device in emulation) forms a system of immense value to the musical performer. Feedback can be applied by any number of motion- or resistance-creating devices.

Another use of the derived vector described herein is as follows. The force of a key-strike could be measured in the usual way using a suitable force-sensor. That instantaneous value is then taken as instance of the normal value of pressure for that key-strike. Deviations from that pressure (within, of course, a standardized transform) could be used to derive any of several unusual control signals not always related to after-touch in the typical fashion. For example, if downward pressure increases after the strike (perhaps combined with, say, slight forward pressure, which forward pressure might be inadequate to cause the control signal engendered by forward pressure alone to be issued (or suppressed by the presence of the increasing downward pressure in another implementation of 'derived' control) a new control signal would be issued. This signal might cause the performer-controlled decay settings of the sounded-note to alter. The increased pressure might cause a real or emulated damping force (such as the many permutations described herein) to be applied to the sounded note. When combined with the motional feedback described above, this could be a satisfying a musical addition to the keyboard-control family.

Control Devices for Musical Performance

Figure 30:
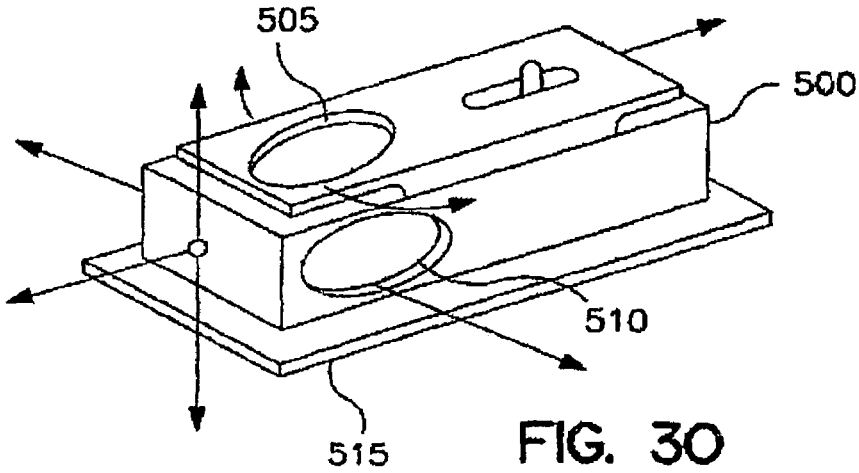
FIG. 30 is an isometric view of a controller according to the invention.

A multi-dimensional controller designed to globally mimic the characteristics of the individual key-parameters described above will now be described. A single key identical to the ones described above may be placed into the position of a global controller. This controller-key may typically reside to the left of the keyboard, although it may be placed in other locations. One further refinement, without disallowing a traditional placement of the controller, would be to place the controller key at the far right and/or the far left of the traditional keyboard. This key might be color-coded to distinguish itself from the pitch-producing keys, or the controller keys might be displaced spatially from the normal keys. Referring to FIG. 30, the several control vectors, or axes, of this controller 500 are shown in Figure J. Controller 500 has a rectangular body having top grip 505 and side grips 510. The controller unit has a stationary base 515, on which is mounted, by a cantilever assembly 520, or foam or other means for permitting two dimensions of motion, a platform 525 supporting ball bearings 530, supporting further platform 535, on which fulcrum 540 is mounted. Key 550 is mounted on fulcrum 540 for movement in three axes. Standard pressure and velocity parameters can be dynamically-modified by keytop-zone sensing, and axial side-to-side motion can be further mediated by rotational torque-ing of a flexible or pressure-sensing rigid key. In use, the thumb and little finger (or middle finger) would grip the sides of the controller body 550, and the index finger would rest on top of the key-assembly grip 505. The wrist would probably rest on a stationary surface. The grips 505, 510 on the controller-body could be pressure sensitive as well. The key-top grip could be rotationally sensitive to pressure as described above and additionally could be deeper and have a slightly enclosing top so that a single finger could be 'embedded' within the key for maximum control. The key-top could be velocity- and pressure-sensitive in zones as described above. The key would be free to move toward and away from the performer, to be rotated axially, and to be depressed with varying velocity and pressure. Regardless of the parameters applied to the key-top, the controller body would be easily manipulated in 3-dimensional space by use of the two-finger grip. Significantly, this simple arrangement allows the intuitive and simultaneous control of perhaps a dozen parameters—all of which relate intuitively to the physiology and psychology of music-making.

Figure 32:
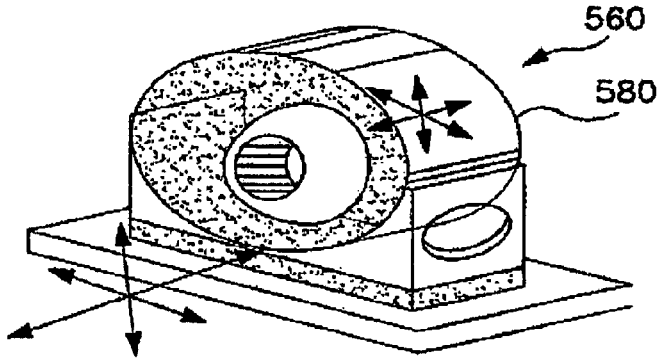
FIG. 32 is an isometric view of a controller according to the invention.
Figure 33:
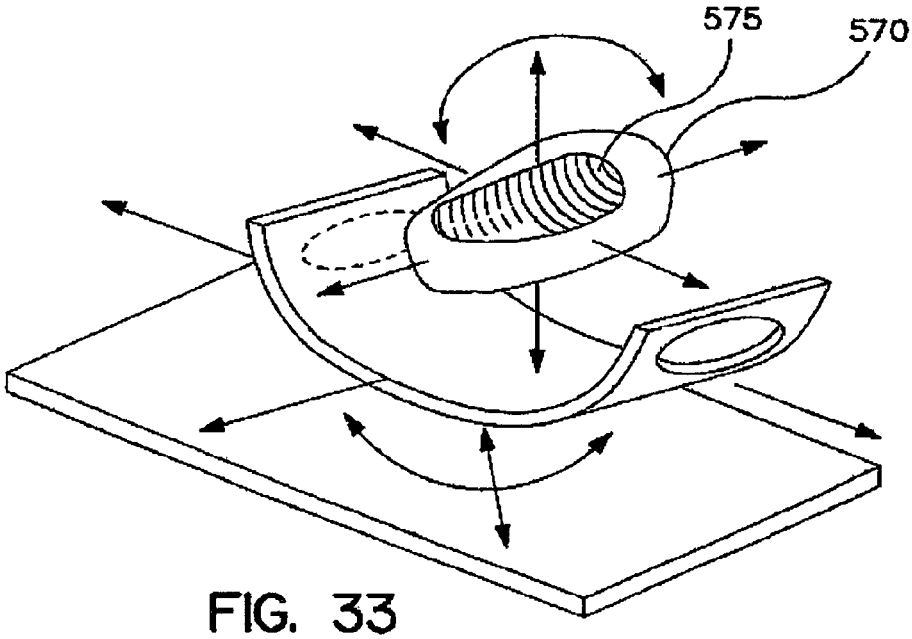
FIG. 33 is a schematic exploded view of the controller of FIG. 32.
Figure 35:
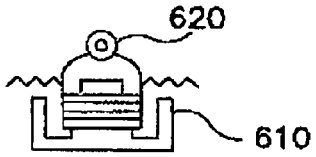
FIG. 35 is a side view of the device of FIG. 34.
Figure 34:
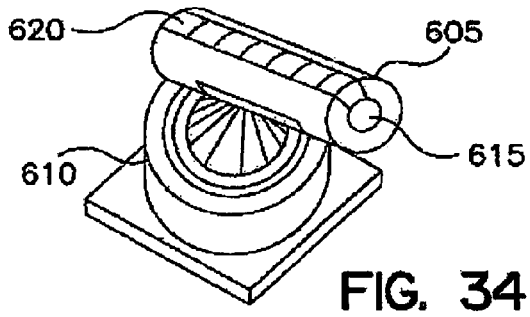
FIG. 34 is an isometric view of a device according to the invention.
Figure 36:
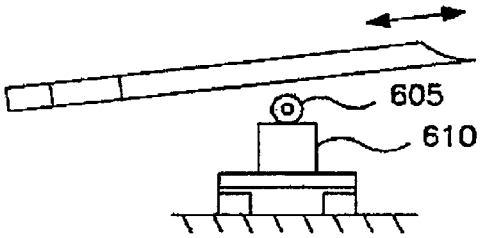
FIG. 36 is a side view of the device of FIG. 34 in use.

Referring now to FIGS. 32 and 33, another implementation of the above-mentioned concepts is shown, namely the use of a three-dimensional spatial controller 560 which both simplifies the key-controller element and allows it to exhibit free 3-dimensional motion within a controller body also capable of 3-dimensional motion. Controller 560 has a pod 570 with a recess 575 having a curved interior designed to comfortably accommodate an index finger. The pod is mounted within controller body 580 to be movable in three-dimensions (sensitive to rotational rocking movements as well as linear x-y-z motion). Suitable sensors are provided to detect motion of pod 570, which may be mounted within compressible foam, cantilever assemblies, supported by springs mounted at a variety of angles, or otherwise. The controller body 580 is held stationary in the grip of the thumb and little finger, but it is free to travel in three-dimensions as well. In this implementation a complex controller resides in a carriage allowing free motion in one or more additional axes not defined by the controller mechanism itself. By use of a controller-body grip, as well as by the enhanced control provided by the spatial-controller itself, the manipulation of the controller assembly elements is made independent of the manipulation of the spatial-position of the assembly. Thus, the entire assembly can be free to float in one or more dimensions, with each dimension dynamically-assignable to global-control parameters. The following assignments of dimensions to control parameters are exemplary. Global volume could be controlled by the downward motion of the assembly. Inter-voice volume could be controlled by the tipping of the assembly while in downward motion. Front-to-back motion might control spatial and positioning parameters, while the raising of the assembly might shift temperament parameters. This assembly is ideally suited to the control parameters associated with the emulation of string-bowing.

Figure 37:
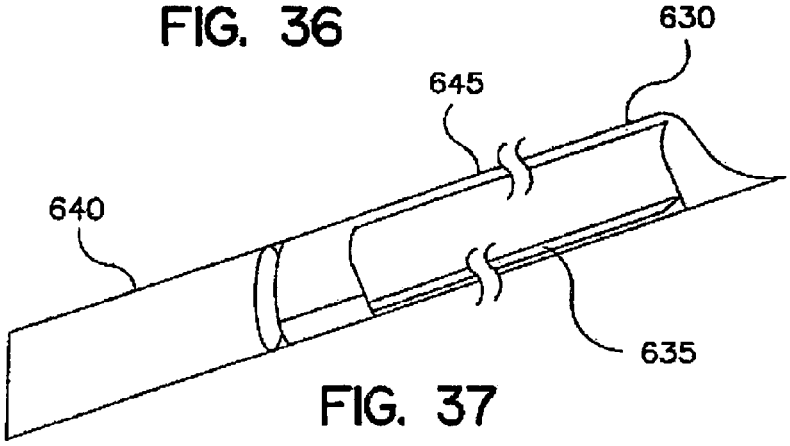
FIG. 37 is a side view of a device according to the invention.
Figure 38:
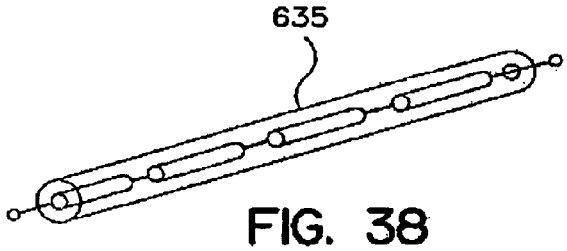
FIG. 38 is a partial view of a detail of the device of FIG. 37.

The use of a controller to specifically mimic the bowing action of violins, violas, cellos and basses is presented here. In its simplest realization, a bow or bow-like assembly is drawn across a rosined (or otherwise prepared) surface such as a tubular or cylindrical shaft. The pressure of the bow is read in the forward/backward axis as well as in the up/down axis. This information is then directed to the synthesis control-parameters. In a further refinement of the scheme, a contact-, or other noise-rejecting-transducer is placed on the bow itself or on the contact surface. The mechanical sound of the bow is High-Pass filtered and added in to the final synthetic or sampled sound. Refining the strategy still further, the bowing surface is made to vibrate in time with the frequency output of the played notes. This vibration then lends a realistic envelope to the generated sound. Additionally, the HP-filtered bowing sound derived from the transducer is more faithful to the characteristic of the emulated string sound. A side benefit is the improved 'feel' of the bowing derived from the motional feedback given by the bowing surface. Yet another refinement is the use of multiple bowing surfaces in close-proximity to one another such that, for example, four areas are fed by the frequency-output of each of four played pitches. A bow wide enough to contact each vibrating area would be employed. This bow could also be fabricated to accommodate, for example, four groups of 'hairs' each of which could be fitted with a separate transducer. The output of each unique transducer could be combined with the appropriate pitched output voice. An additional refinement would be to model the frictional feedback of such an assembly with a reciprocating surface which, acting like a bow, would ride over the sensing surface. Referring now-to-FIGS. 34-38, there is an emulator 600 having a small ferrous-metal tube 605 suspended on an audio transducer 610. The audio transducer may be of any type. The tube 605 contains an electromagnet 615 and a non-ferrous gap 620 across its top surface. The bowing device 630, shown in FIG. 37, has a handle 640, bow hairs 635, mounted on a bow body 645. Ferrous metal is part of the composition of its bow-hairs 635, or placed immediately behind the standard bow-hairs. There are many ways to implement this. The metal might be exposed or wrapped with a gut-like plastic, and could be made with or without rosin. The ferrous bow-hairs might contain regular lumps or serrations, or be short metallic particles embedded in the 'gut' exterior. The use of serrations and the like allows the magnetizing coil of the string-emulating device to detect bow-speed by induced EM. Alternatively, the string could be fitted with any number of pressure sensing devices to accurately gauge lateral pull on the string. Additionally, there are any number of methods to sense the vertical bow-pressure on the string-device. By any number of methods, the sensing of bow-motion by the magnetizing coil itself or otherwise, the device senses the first motion of the bow. The note being played on another instrument, such as a synthesizer, for which it is desired to apply an accurate bowed envelope, is, after appropriate amplification and impedance-matching, then fed simultaneously into both the magnetizing coil of the string device and into the audio transducer to which it is mechanically coupled. The combination of the effects creates the elements of the bowed envelope. Either of these two strategies can be employed singly. Bow-speed creates lateral pressure on the string which is in direct correlation to the downward bow pressure and the bow velocity. As this signal grows in amplitude, so does the simultaneous signal level of the audio transducer or shaker 610 and the electromagnet 615. The curves of these devices are non-linear, and as a result, the maximum amplitude is easily achieved. The motional-characteristics of a bowed string may be fed-back to the waveform-synthesis or envelope-generating part of the sound-source. A pick-up placed on the bow itself can be employed in the following way. The audible acoustic signal of the bow rubbing against the string can be high-passed to retain only the modulated white-noise of the bow-hairs in frictional motion. The HP'd 'bow-noise' signal can then be added back into the sound of the synthesized string itself. Simultaneously, the low-pass filtered signal may be taken and an envelope signal may be derived that is the time-duration of one cycle of the played note. This asymmetrical envelope can then be applied to the raw sound powering the string itself. The finished audible sound may be derived from a wide-bandwidth audio or magnetic pickup which either alone, or blended with the raw sound driving the string-assembly, adds asymmetry typical of bowing's frictional dynamics. The sensing surface could use traditional frictional feedback like that provided by rosin, or it could contain electromagnetic sources driven by the pitched outputs of the played notes. These sources would attract the bowing. (reciprocating) surface, which would contain magnetic material, in order to emulate the feedback and non-linearity of a physical bowing device. The various bowing attacks could be further emulated by defining an additional axis on the sensing surface. In the case of the multiple-pitch system, which might replicate the attached Figures to include multiple strings, the sensing axis might be rotationally along the sensing surface. This can be accomplished in a number of ways by the use of additional pressure sensors positioned along the axis of the string or the width of the bow-hairs. These could detect, by differential pressure, any rotation of the bow-device against the string-device. The effectiveness of this emulation would be further increased by increasing the presence of high harmonics and odd-order harmonics while decreasing the amplitude of the fundamental of the performed pitches as the bowing device is brought in contact with the edge of the control surface. The finger-pod controller of FIGS. 32-33, with minor adjustments like those described here, could be the ideal housing for this type of control apparatus. In fact, with appropriate feedback, the pod could be employed for a variety of emulations like the one described here. The pod itself could emulate the bow by applying motional feedback to the pod from a mechanical or magnetic device pulsing in time and amplitude coherence with the modulated signal controlled by the bowing action of the finger-pod.

The foregoing data is employed in a method and system of determining the gestures of the performers and using the determined gesture to control the sound output of a musical instrument. Broadly, there are three tiers of data captured by any of the foregoing methods and hardware and traditional data hardware. The three tiers are (1) traditional data, such as the striking of keys, (2) data based on intentional movement of keys and impacting of sensors based directly on actions by the performer, including side-to-side key movement, touching of keytop sensors, and touching of sensors or units located in keytop wells, and (3) data based on sensors, such as key strain gauges and accelerometers, that do not directly sense actions of the performer. These data are received by a controller and using algorithms executed in software or other suitable techniques, derive the gestures being made by the performer. For example, a gesture of gently brushing a key toward the performer may be derived from a combination of detecting force information from sensors in certain key top zones occurring in a certain temporal sequence, with minimal readings in a key strain gauge. The result of the calculations accomplished by the algorithms are employed to control the sound output of an instrument. Using this technique of deriving algorithms to determine gestures, there is provided a mediating layer between the performer and the resulting sound. It will be understood that data from two or more of these sources may employed in obtaining gestural capture.

The method of determining or capturing gestures preferably employs selected electronic hardware. Each signal may be provided with its own conditioning electronics hardware. The initial onset of the control signal may be difficult to detect until the completion of at least one full cycle of movement or by the gesture reaching a threshold time length. Comparisons must therefore be made with a very fast response time between relative levels, envelopes, frequencies and other characteristics of each control signal simultaneously, or nearly simultaneously received, from the gestural inputs of the performer. Small time delays in such factors as rise-time of control signals will help to mask control signal cross-talk resulting from onset-stage ambiguities. Control signal ambiguity is removed through passing each control signal through a matrix of time vs. amplitude analysis devices, or very fast software, that make use of suitable algorithms that may be developed by those of ordinary skill in the art after suitable testing. This may be done on a key-by-key basis, and the matrix compares the amplitude, envelope or LF signal shape) frequency and, optionally, history of each key in relation to the other keys. The idiomatic signature of a given player's style and/or of his approach to a performance can be known and flexibly optimized.

In determining gestures, it is important to note that not only the contact of a key, but the manner in which the key is contacted may be detected and may result in change in output when processed by the mediating layer. An example is the use of keytop sensors to detect the area of the keytop being struck, from relatively small for use of just fingertips, to relatively large for use of a large area of the finger.

It will be understood that the foregoing methods may be achieved either in a real keyboard instrument or in a simulated or virtual keyboard instrument. The proposed controllers above or other controllers may be employed to achieve a simulated virtual keyboard having keys with tactile characteristics, such as wells or areas of varying friction, in the key top. Synthesizer keyboards may be provided with sensors to achieve the effects of a modified piano or other keyboard instrument keyboard.

Side-to-side motion detection may be emulated in keyboards with keys not mounted to rotate about a vertical access. For example, sensor may detect the very slight side-to-side motions permitted by such keys. Sensors may be located to sense merely the attempt by the performer to swing the key to the side; for example, by the use of sensors in a keytop well, a force to one side or the other of the well may be interpreted as a rotation of the key.

Overview of Acoustic Instrument Implementations

Although there is a certain amount of flexibility in the translation of the electronically-implemented parameters to the acoustic/mechanical realm, we will describe specific implementations of the above-described control parameters in a mechanical instrument. In this age of electronic keyboards it may seem superfluous to apply these concepts to traditional mechanical instruments. In spite of great advances, however, electronic keyboards have remained largely a distinct family from acoustic keyboards. The possibilities for non-traditional acoustically-derived instruments are not yet quaintly anachronistic musings. We will take the basic form of the traditional acoustic keyboard instrument as the point of departure for these discussions of the implementation of new control parameters in acoustic instruments. Controller-type parameters are usually global in nature, affecting all of the strings of an instrument at once. There are clearly simple ways of implementing global pitch shifts and timbral shifts that need no discussion here. The alteration of pitch, volume and timbre on a string-by-string basis is of interest to us here. Although there are numerous ways to implement these modifications to an existing piano, harpsichord or clavichord and their modern derivatives (and even to some related non-keyboard stringed instruments), we will focus on piano-like implementations that serve to emulate electric-guitar-like phrasing characteristics. There are many practical ways, which will be evident to those of skill in the art, to create the linkages required to implement the following concepts in a purely mechanical way, and many more electrically and electronically-assisted possibilities.

An acoustic keyboard can be fitted with the following options, each of which are discussed in more detail below:

servo-controlled tuning and unison-de-tuning

First, the reason for servo-tuning is fundamentally different—to actively re-tune tempered intervals into just-intervals in real-time as music is performed. An added bonus is accurate long-term tuning that accommodates climatic changes and metal fatigue. Second, servo tuning permits one to selectively adjust the sonic-quality of unison strings by allowing selective de-tuning for chorused and multiple-key-center effects of varied magnitude. Finally, servo-tuning permits intentional de-tuning or mis-tuning of the keyboard.

silent key-strike capability

Silent striking is contemplated in two modes. In one, the key is activated in such a way as to not excite sound, for instance, by lifting instead of depressing. In another, the key is struck in a, perhaps, conventional way, but control parameters define that the hammer-action is disabled or modified in such a way as to nearly eliminate attack onset, as by, for instance, an attenuated strike by an extremely soft hammer surface.

magnetic damping and excitation

A variety of magnetic damping and excitation procedures will be described allowing real-time control of timbre.

selective mechanical damping

Mechanical dampers are modified in such a way as to allow post-release control of string damping on a note-by-note basis. Additionally, global or individual damping is described which allows dynamic decay profiles to be modified beneath the decay profiles typically created by the existing damper system.

enhanced pedaling options

The lack of more control over the pedal-controlled decay of the conventional acoustic keyboard (and the synthesizer) is examined. A multi-axis system is revealed.

pitch-bend, both up and down

Global pitch-bend such as is available on the synthesizer is of little practical use with the acoustic keyboard, although a system of globally increasing/decreasing either tension or length of strings is easily applied to conventional designs. Described here are numerous systems of note-specific pitch-manipulation.

noise and feedback rejecting mic'ing

Some methods of vibration-detection are described.

small-amplitude vibrato pitch-control

The fundamental concept here is two-fold. First, that some or all of the control functions are derived functions. That is, controllers receiving identical or similar data are combined and/or compared with one another and with other data-streams to derive control-vectors which may not be clearly accessed by direct output from those same controllers. Second, that small (short time-value) pitch or timbral variants are divided conceptually from grosser variations to create unique zones of effect.

varying attack-hardness and attack-position

Both the position of, and hardness, shape, rigidity, mode of excitation, and other characteristics can be directly manipulated by a performer through proper global and/or individual control devices.

enhanced dynamic-envelope options and timbral possibilities

In addition to the variations described above, a variety of schemes are discussed to enhance the timbral possibilities of the keyboard.

It will be understood that the following may be achieved by providing one or more suitably programmed controllers, which may be dedicated controllers, or may be programmable controllers with specific functions implemented in software. In general, the motions of keys will be detected by sensors that will provide electrical signals to a controller. The controller, in response to its programming, will provide control signals to mechanical control mechanisms, such as servo motors.

Detailed Discussion of Acoustic Piano Modifications

Pitch Bends

Figure 39:
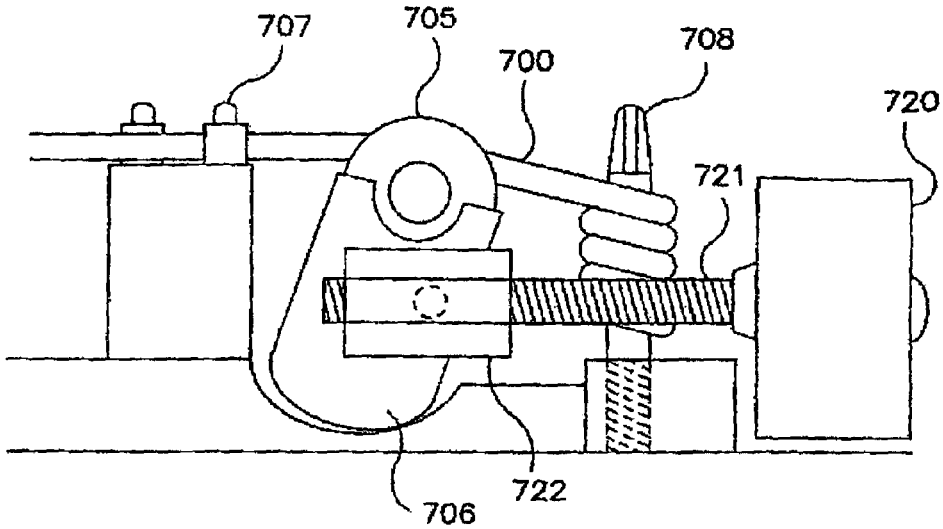
FIG. 39 is a side view of a device of the invention.
Figure 39A:
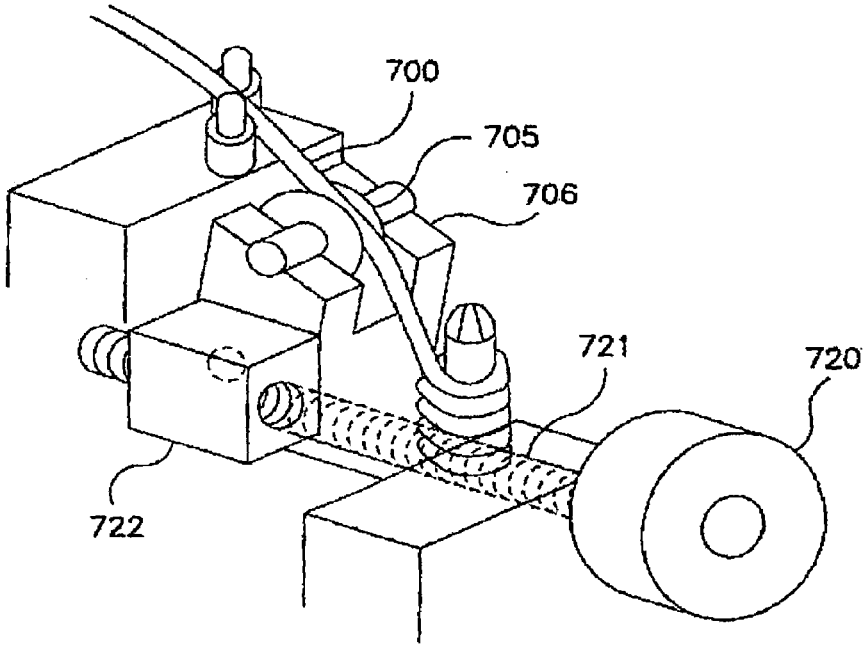
FIG. 39A is a schematic isometric view of the same device.
Figure 41:
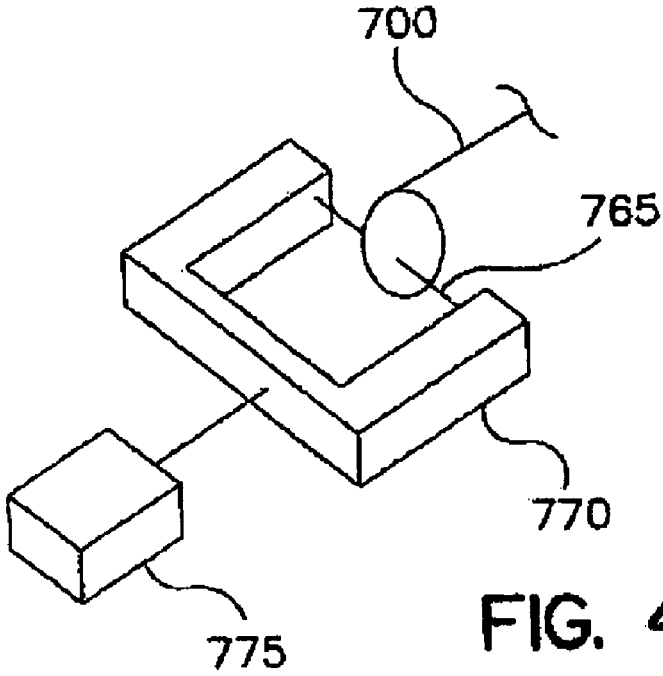
FIG. 41 is a schematic isometric view of a device of the invention.

One simple way of mechanically implementing pitch bends is to employ the simple mechanism described here. Referring to FIGS. 39 and 41, one end of the string 700, probably the (usually acoustically-inactive) end of the string nearest the performer is anchored on a grooved wheel 705. Wheel 705 is preferably intermediate bridgepins 707 and tuning pins 708. The wheel 705 is mounted to rotate about its axis, but is kept in stasis by a detent resting on a retractable stop. The wheel is mounted on holder 706, which may be referred to as a swinging tension element, which is able to rotate about an axis perpendicular to the string so that wheel 705 moves inward or outward on string 700 upon rotation of holder 706. Holder 707 is moved by step motor 720 by a driven screw 721 received in worm nut 722 mounted in a swiveling manner on holder 706. Upon activation of the upward pitch-bend (probably by the right-swing of the key) the wheel 705, under the control of a servo motor not shown, coupled to the key-motion, tightens the string-tension giving direct, nuanced, control over the pitch of the string. Upon activation of the downward pitch-bend, (probably by the left-swing of the key), step motor 720 is activated to swivel holder 706 and move wheel 705, thereby adjusting the tensioning in the string. Dampers might be left lifted in this event, also by a stop or catch. The entire strategy also works if string-length were similarly manipulated rather than, or concurrently with, string tension.

Figure 53:
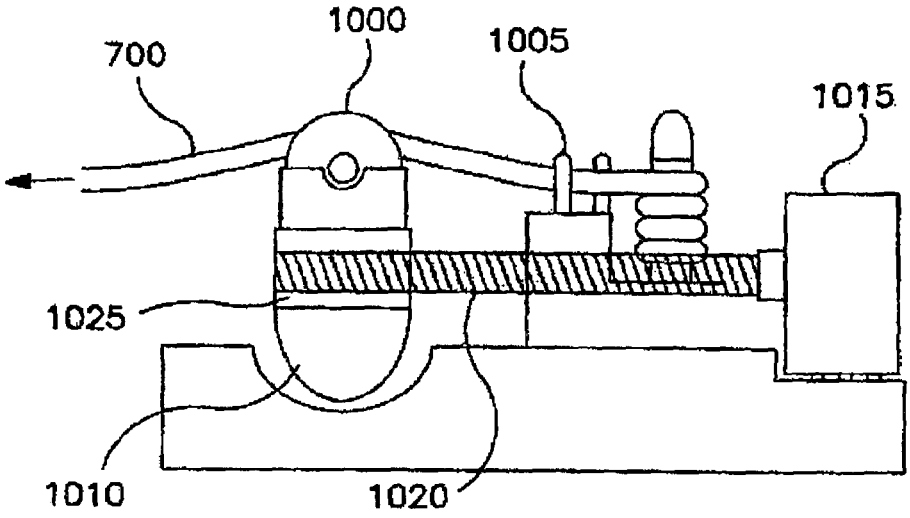
FIG. 53 is a side view of a device of the invention.
Figure 54:
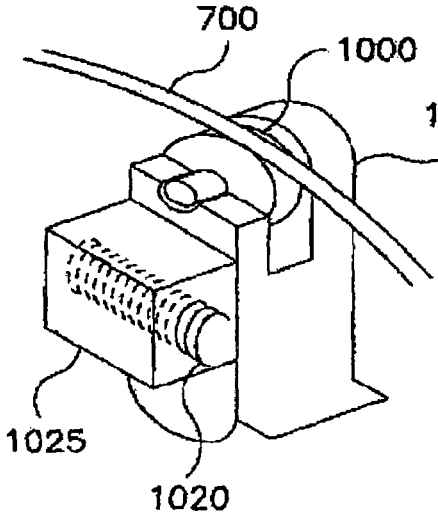
FIG. 54 is a partial isometric view of the device of FIG. 53.

In an alternative embodiment, referring to FIGS. 53 and 54, there is shown string 700 supported by wheel 1000 between the hammers, not shown, and the bridgepins 1005. Similarly, holder 1010 is mounted to rotate to move wheel 1000 along string 700. Step motor 1015 actuates screw 1020, which is received in worm nut 1025 to move holder 1010. Holder 1010, as is holder 706 is mounted on the sounding board.

Non-Sounding Lifting of the Key

In the case of the lifting of a key, there is little need to discuss a mechanical linkage because it is our intention that the lifting of a key not engender a concomitant working of the action itself, but rather should modify a note already sounded. In the event of harmonic manipulation, while it is clear that a unique damper, a half-way point for example, could be engaged by such a motion through purely mechanical means, it is most likely that such an event would be moderated by electronics. In the event of key-definition, as outlined below in the discussion of FJT, the act of raising the key would be best defined by the simple closure of a contact or the level-sensitive reading of a pressure-sensor.

Pulling & Pushing of the Key

Figure 40:
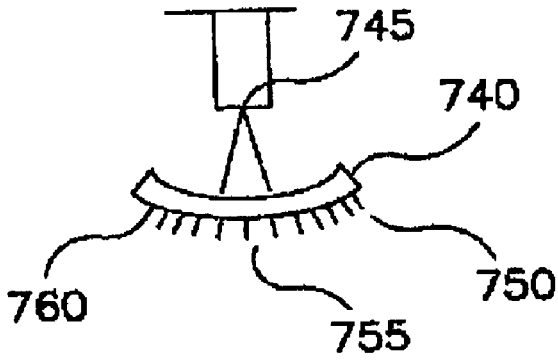
FIG. 40 is a schematic side view of a device of the invention.

Considering the pulling or pushing of a key toward, or away from, a performer there are many possibilities. Various configurations of a key that may slide toward or away from a performer are discussed above. Various effects may be associated with the detection of the sliding of the key. One of these is to simply slide the hammer toward or away from the performer in order to alter the brilliance of the sounded note. Another possibility, referring to FIG. 40, is that this action would leave the point of strike unaltered while rotating a surfaced wheel or partial wheel 740 that is rotatably mounted at 745, and under control of a servo motor (not shown) to form the strike-point of the hammer mechanism itself. The surface of the wheel 740 might graduate from a very soft at 750, to a firm, at 755, and then hard surface, at 760. The normal, resting, key position would present, say, the typical felt hammer tip at 755. Upon pushing the key away from oneself, the surface would rotate to a very soft, fluffy surface at 750. Pulling the key toward oneself might present a surface as hard as plastic or glass at the extreme end of the action at 760. In a more complex realization, pulling the key toward oneself might make a clear shift from, say, traditional hammer action to, at moderate extension, a plectrum-like mechanism. With decision-tree intervention and electromechanical, for instance, implementation any of the gestures or derived gestures can control any of the anticipated functions. Pulling a key momentarily toward oneself, might with intervention, modify the release-time of the damper mechanism. Naturally, the full range of sensing devices anticipated for the electronic keyboard could be profitably fitted to an enhanced mechanical keyboard. Pulling the key in and out could then be, for example, a bowing emulation. This use of the gesture might be triggered by a finger sliding along the sensor-laden key-top prior to depression of the key, or perhaps by the simple depression of a pedal. The bowing action might be purely mechanical, or it might be implemented magnetically, as described below.

Two-Zone Control

An example of the two-zone (large and small pitch) system might be the following: a small back-and-forth rocking of the key, by use of the, say, key-well vibrato, is applied to the string by a linkage to either a small saddle or bridge rocking either side-to-side (thus tensioning the string) or in and out (thus lengthening and shortening the string) or by direct application to the mounting structure of the pitch-wheel device 705 described with reference to FIG. 39. That is, the entire wheel assembly described is mounted as shown in FIG. 41, supported on axle 765 supported on bracket 770 which is movable along the axis of string 700 by schematically shown servo motor 775, which is controlled through by means of a slight, direct, side-to-side motion of the key. In this way, the vibrato is independent of, and may be superimposed upon, the larger pitching action of the pivoted key.

Damper Modification

We suggest possibly two distinct modes of damper action. The first mode is the existing mode—that is, the dampers drop to the strings upon release of the keyboard-keys of the piano unless the sustain pedal is depressed. In this case the piano is globally prevented from damping action. (Another existing, but little-used strategy is selective note-sustain by an additional pedal, the 'sostenuto'.) In our innovation, the depression of an additional pedal, which should be a gradient-sensing or gradient-creating pedal is employed to create decays that are longer than the normal staccato-decay, but shorter than the free-decay of the un-damped mode. This pedal can be effectively implemented using purely mechanical structures, but electronic or other automated methods, such as moving the damper by a servo motor, are likely to be superior. Each damper is lifted in the normal way, as a key is depressed. But, upon release of the key, if the proposed 'selective-decay' pedal is depressed, the damper remains lifted. The damper falls slowly with a speed set by the level of pedal-depression. There are numerous ways to soften the effect of the damper as it comes into contact with the sounded string. A softer material might comprise the first layer of the damper. A significantly longer damper which creates air-resistance against the string as it approaches might be employed. The timing of the release of the damper might be such that the damper remains raised for a period of time then swiftly makes contact with the string. This latter method would result in an unnatural decay profile unless used in conjunction with the damper. This suggests another method which could be used with the modified damper action or simply in conjunction with the existing sostenuto pedal and traditional damper mechanisms. In this variant, the strings are damped by selective damping material applied progressively to the anchored ends (or free vibrating area) of the strings. This damping material could be globally applied or triggered individually. The strategy is of particular value in conjunction with the concept of delayed-release dampers to allow the selection of multiple sustain effects through the use of the sostenuto pedal as well. Damping material applied to the ends of strings can have very subtle effects, allowing the damping to be applied globally if so desired for a variety of effects while the sostenuto pedal is activated. The damping mass could be slid further onto the string or applied to the string with greater or lesser force to achieve various sustain characteristics. Another variation is to weight the sustain either equally or with increasing value as the mass of the sounding strings increases. This weighting function allows the sustain of all of the piano's strings to be equal in length, thus overriding the natural longer decay of the longer higher-mass strings. The nature of this mass/decay ratio could be altered dynamically through the use of a pedal with two axes of deployment within it. A selective sustain pedal that allowed normal (mass-related) damping when depressed to varying degrees on one side might yield more and more equal decays when depressed, for instance, on the other side.

Modified Soft-Pedal

The 'soft' pedal, which normally shifts the hammer-mechanism to the side so that two-strings of three unisons are sounded (in the primary range of the piano) can dramatically reduce cost by allowing a mode of play in which a single string is employed for each note of the entire range of the keyboard. Because this mode of play might be of special importance, a soft pedal modification is suggested, or an additional device/pedal is suggested, containing an additional single-string position with an option to 'lock' the keyboard into that mode. Concurrently with that mode of operation, it is further suggested that a piano so equipped might be equipped with servo tuning and other special playing modifications described herein be modified to shift the hammers so that a single string is struck. This is not trivial for two reasons. First, modern electronics makes the use of a single string as a sounding-element desirable in cases where complex transformations are applied to the root sound, such as distortion. Pitch-shifted chorus and de-tuning effects can then be applied to the signal at the appropriate point in a signal chain to emulate the multi-string effect. This is of particular value for professional acoustic instruments and if the chorused or processed signal were amplified and reapplied to the sounding board or other adjacent portion of the piano by means of any audio transducer such as a speaker. Second, a complex and potentially costly deployment of auto-tuning devices could be cut over a restricted range of play. The same is true of all control parameters—the use of control parameters can be eliminated or reduced in extremes of keyboard range.

A single-string per note piano could be electronically amplified, processed in any of the many ways described, and have the output of the electronics applied acoustically back to, say, the sounding board by means of, for instance, a vibrating transducer anchored directly to said sounding board, thus creating the illusion of a multi-stringed unison. For professional use, the output of the transducers could be selectively shunted from the acoustically-coupled strategy to external amplification. Also for professional use, I envision a single-string per note device fitted with controllers described herein, strung with lighter-gauge strings, and of restricted keyboard-range approximating the range of the guitar.

Magnetic Damping

Figure 42:
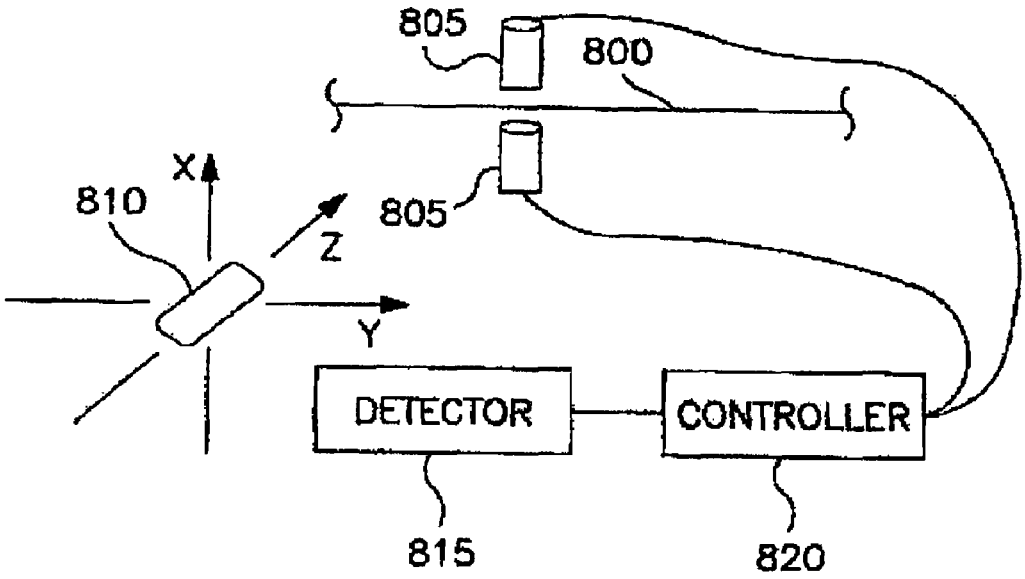
FIG. 42 is a schematic view of a device of the invention.

Referring to FIG. 42, electronic damping of the strings, such as string 800, is also possible through the use of an electromagnet 805, or electromagnets, whose gap(s) spans the string and which is fed by an out-of-phase signal derived from the string itself. That is, the electromagnetic field from such a magnet opposes the vibratory motion of the string. By dynamically altering the amplitude of the signal fed to the magnet, a variety of decay and sustain curves may be achieved. In-phase signals can also be used in such an arrangement to enhance sustain as well. A three-axis pedal 810 is shown schematically where one axis slides from sustain to neutral to damping, while another slides from more applied power to the magnets to less (this also could be a single axis of control moving from infinite sustain to near-immediate clamping), a finally another axis which moves from natural-physics sustain to a weighted or equal (or even inverted) sustain. The detector 815 detects motion of pedal 810 and provides motion data to controller 820, which provides control signals to electromagnet 805. It should be noted that the point of application of such a field, and the breadth of application of such a field, dramatically alters the harmonic content of the string. If the damping signal is applied at the moment of strike at equal divisions of string, length (half-way, third of the way etc.) the fundamental frequency can be damped away. The control and processing electronics of such a system would allow for the recall of complex damping and enhancing signals. A dynamically programmable array of amplifiers and filters capable of shifting from expansion to compression modes smoothly, and of enhancing or suppressing fundamentals or overtones can yield a startling array of waveforms.

Exciting the String with Added Sounds

Figure 43:
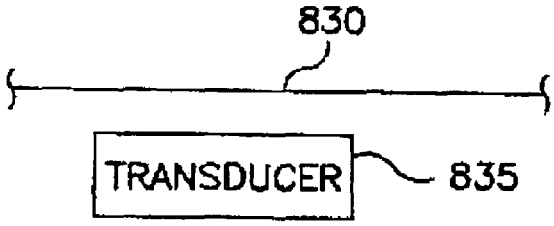
FIG. 43 is a schematic view of a device of the invention.

Significantly, pre-made sounds can also be applied to the sounding string through the magnet, or acoustically through transducers as indicated by FIG. 43, showing transducer 835 associated with string 830. Chorused versions of the acoustic sounds, exact or slightly detuned analogs of the pitch of each string, white-noise bursts, and in the case of bowing emulation, modulated noise and amplified high-partials might be used to excite the string and subsequently damp it. Circuitry capable of simultaneously amplifying one half of the phase-cycle of the string's waveform and ignoring, suppressing or asymmetrically amplifying or opposing the other half of the cycle, and doing so dynamically over time allows a variety of acoustically created, but electronically-modified emulations of various sonic-excitation strategies.

Integrated Implementation of Timbral and Envelope Modification

Electronic, magnetic, or mechanical modification under (dynamic) parametric control of an acoustically-generated sound-source is provided in such a way as to engender a new acoustically-generated sound-source of different character. This may be described also as the inertial-mixing of synthetic sounds with acoustic sounds in the purely acoustic realm. The action of the hammers may be disabled or severely muted, using suitably controlled servo motors controlling the hammers, in such a way that the onset of the dynamic envelope of the string is non-percussive or at least mostly or entirely created by the excitation of the magnetic exciting device. There are two distinct implementations here. One relies on the use of an impulse derived from the string itself. The other relies on a synthetic or pre-stored impulse tuned to the string or to the string's partial(s). Upon the depression of a key, bursts of white-noise, pink-noise, 'thumps', sinusoids/waveforms containing any blend of harmonics and fundamentals can be used to excite the string into motion in the absence of, or in augmentation of, the hammer-strike. Once this signal is obtained, the strings can be kept in perpetual excitation, thus relying on the dampers alone to silence them. In this way, upon the lifting of dampers the string begins to sound without the need for a percussive impulse at the onset of the tone. These bursts, if employed, might be triggered by the depressing of a given key.

Second, electromagnets (possibly combined with sensing transducers, which can be done through the simultaneous use of the electromagnet by removing the driving-signal from the sense-circuitry by phase inversion, and examining the remaining induced signal for frequency and/or harmonic content and amplitude) may be provided associated with each string in locations correlating to the fundamental, the second and third harmonics and so on, and higher harmonics can be globally excited or filtered through the use of an array of coils packed closely together. The position of these magnets is critical. Each magnet is free to receive no drive information or to receive any dynamically-varying phase-positive or phase-negative signal. The signal in each magnet can, further, shift from phase-positive to phase-negative or vice-versa at any time in the envelope of the sounded note. One exemplary implementation, however, is to isolate the first, say, two or three harmonics and then further isolate the fourth through x harmonics. For the fundamental, the string is preferably excited in an area yielding a pleasant timbre and subtractive forces applied to the resultant tone if a sinusoid-like wave were required. The fundamental is a special case, because generally the sinusoid fundamental is of little musical interest and would require a centrally-positioned magnet with a broad area of action to avoid inducing simply the $2^{nd}$ harmonic. The suppression of the fundamental, though, is of interest and this can be accomplished by effectively fixing the string at the moment of impact in its exact center. This could be accomplished magnetically by sensing the slightest string-motions in this central position and strongly opposing them, thus damping the string heavily. For the high-order harmonics an assembly with (permanently) manually-settable positions in a small array of individual coils is desirable. Otherwise, the single coil with positionable poles to correspond to the nodes, or points of maximum modulation, of the individual high-order harmonics would prove musically useful. Experimentation suggests that these harmonics are best modified near the termination point of the string. Mechanical or magnetic damping may be effectively applied to a single axis of vibration of the string, but in the case of short-wavelength harmonics there appears to be more freedom of vibrational axes, thus suggesting the use of oppositional or supporting energy applied to the string across a wide angle or in multiple axes. The foregoing may be summarized as a damping/enhancing system that may be comprised of such an aperture, and a similar wide-aperture or multiple axis sensing system. Magnetic damping of the fundamental and low-order harmonics may be combined with a broad selective-damping of high-order harmonics, such as by mechanical damping.

Artificially enhancing or augmenting the HF-content of a string at the point of impact or, conversely, reducing the attack's impulse, while perhaps then enhancing the HF-content later in the string's sounding, may be accomplished. This will allow the emulation of various hammer/pick/mallet/bow qualities without the mechanical manipulation of those qualities. External excitation or modification of sensed-audio, applied to the string with, or without, other synthetic components may be employed broadly in attack-shape control of acoustic instruments. Purely magnetic sensing with a single coil may be employed, or an array of three, or a higher odd number of, closely-spaced but field-isolated coils would work, with the sensing element in the center position. Alternately, optical sensing, for instance, could be employed. Another sensing modality is the use of a small ultrasonic transducer. The transducer focuses tightly spaced pulses of sound, or if a receiving transducer is positioned to 'hear' predominantly the reflected sound, a constant ultrasonic tone, onto the desired axis (or with an array, axes) of motion of the string. These pulses reflect from the moving string and become superimposed with Doppler-shift data. The resultant signal is acoustically-sensed through high-pass filtration that eliminates the presence of the actual sound of the string. This signal then bears the Doppler-shift information which can then be extracted from the signal by filtration and low-pass smoothing and re-applied to the string (through phase-controlled processing) magnetically. The sensing could also be directly done by small microphones positioned immediately adjacent to the strings and employ the same strategy. An advantage of the Doppler strategy is that no actual acoustic-sensing is required, thus eliminating air-motion from the sensing-strategy—air-motion containing a mix of adjacent string-sounds, room-noise and, significantly, spill from amplification systems during performance. If this were employed for aesthetic purposes as a mic'ing strategy for recording or performance many technical and aesthetic benefits accrue. Complete isolation, even from other parts, or systems, of an instrument, immunity from room-noise, leakage, and feedback, and the ability to control tone by separately sensing, for example, strings themselves (even in varied positions) and a sounding-board or bridge. With the use of a tightly-stretched reflective diaphragm (free of resonance in the audible-range) placed in the vicinity of a non-reflecting sound source, such as a human voice, direct sensing of air-motion can be done as well by simply aiming the ultrasonic array at the diaphragm. Although this use re-introduces air-motion induced contamination, it does so without sensitivity to feedback and without any significant mass or reactivity coupled with the reflective diaphragm, which could induce damping, LP-filtration and unpredictable resonances. Feedback immunity alone is reason enough. It should be mentioned that short-wave radio-waves, like microwaves, in extremely-low wattages, could also be employed for these purposes. Aluminized diaphragms and/or reflective aluminized stickers, or aluminized surfaces applied by spray, could enhance the microwave's ability to reflect from, and thus detect, surfaces not normally reflective to microwaves. Light, likewise, could be employed with different demands. It is This Doppler strategy also allows for isolation of individual mechanical significant that if a sensing-frequency were employed which is the same as, or a multiple of, commonly-employed data-rates for digital audio (non-standard rates could be derived by conversion) for example 44.1, 48, and 96K or their internal bit-rates (44.1K times 16, 96K times 24, 20 or 16, for example) the audio signal could directly converted by the sensing methodology itself, into a digital bit-stream. The direct conversion methods can be outlined elsewhere, but, briefly, in the case of a carrier-frequency equivalent to the byte-rate of the audio, the instantaneous deviation from the carrier frequency created by Doppler-shift, is converted into a value expressed in bits. This is done by direct-sensing combined with multi-sample interpolation. In the case of a carrier-frequency equivalent to the bit-stream rate, each cycle of the carrier is resolved into bit through quantization, the bits can represent Delta-velocity, for example. This stream of bits is then re-computed, if required, to correspond to the nature of the standardized bit-stream.

Auto-Tuning Strategy for Acoustic Instruments

Figure 59:
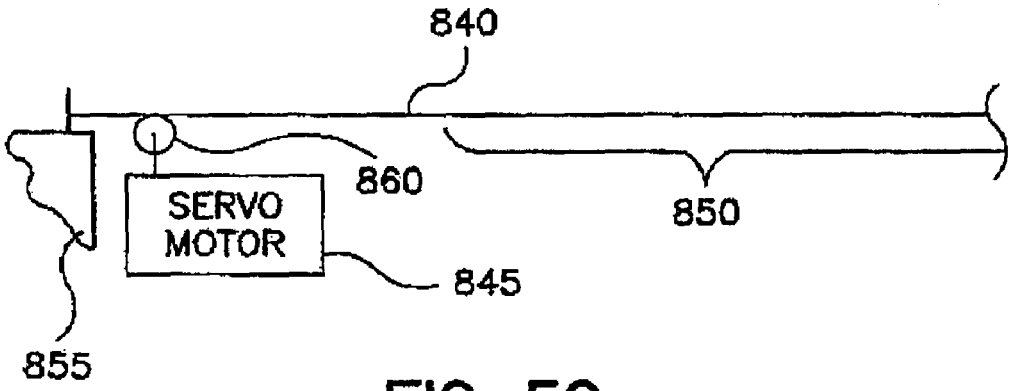
FIG. 59 is a schematic view of a device of the invention.

Referring to FIG. 59, each string 840 of an acoustic instrument may be fitted with a vastly geared-down servo-motor 845 or step-motor or other controllable motional device. It is not appropriate for many reasons to directly manipulate the tuning pins of a traditional piano. For this reason, the tuning device must be an intermediary tension/length controlling element between the active vibratory portion 850 of the string 840 and the stationary pin-block 855. This device might take the form of a disc or cylinder 860 around which the string is wrapped from one to several turns. This disc would float in the acoustically inactive space just prior to the final tuning pins. Frictional components caused by the terminations, the secondary-scale bridge, and the damping felts might require modification in the form of low-friction rockers, sliders or wheels. These are active in coupling the string to the harp and sounding-board, so care must be taken to make the acoustical-coupling exceptional of such a friction-reducing device. Pulleys integrated, for example, into the underside of the harp might be crafted in such a way that their bearings would be cylindrical and exceptionally tight-fitting. Additionally, exterior bearings might be employed that snugly ensconce the active, string-contacting, element in such a way that only a tiny portion of the wheel is exposed to contact. A rigid transducer might be placed with this assembly to directly sense string-pitch. The interposed 'tuning' disk might tension the string in a variety of ways. One way is to simply design the disk in such away as to cause a frictional gripping of the disk to the string and to rotate the disc slightly clockwise or counterclockwise to re-tension the string. This would reduce the audible effects of mass on the sound of the instrument. The gross tuning would be set once, beforehand, by hand on the traditional tuning pins. In a similar scenario, the disc might be designed to expand or contract in circumference in order to re-tension the string. The hub of the wheel might be composed of wedges. The rim might be mildly elastic, or composed of expandable pieces, or floating from the hub. The hub would be fused to a series of wedges around its inside diameter. Interposed with these might be a series of opposing wedges. These wedges would be sized in such a way as to only fit half-way into the hub arrangement in the normal, at-rest size of the wheel. Driving the wedges between the fixed wedges would thus increase the circumference, thus shrinking string-length and raising the sounded pitch, while retracting them would shorten the circumference and lengthen the string, decreasing its tension, thus lowering its sounding pitch. A gear array such as that employed in the chuck of a drill is the general form of the linkage. This array might be driven by a step-motor, or perhaps by an inexpensive, relatively high-speed small motor. This motor would be dramatically geared down and probably fed a fluidly-varying current to control tensioning dynamically with feedback alone, rather than accurate servo- or step-control. The motors themselves would probably float on the string itself to avoid uneven tensioning developing on each side of the tuning-disk or communication of vibration to the sounding-board. Motor-vibration communicated into the string itself could be effectively damped mechanically from the non-vibratory length of string with felt or equivalent material.

Figure 55:
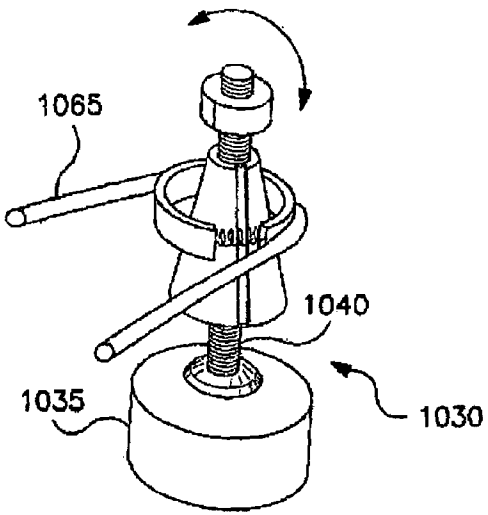
FIG. 55 is an isometric view of a device of the invention.
Figure 56:
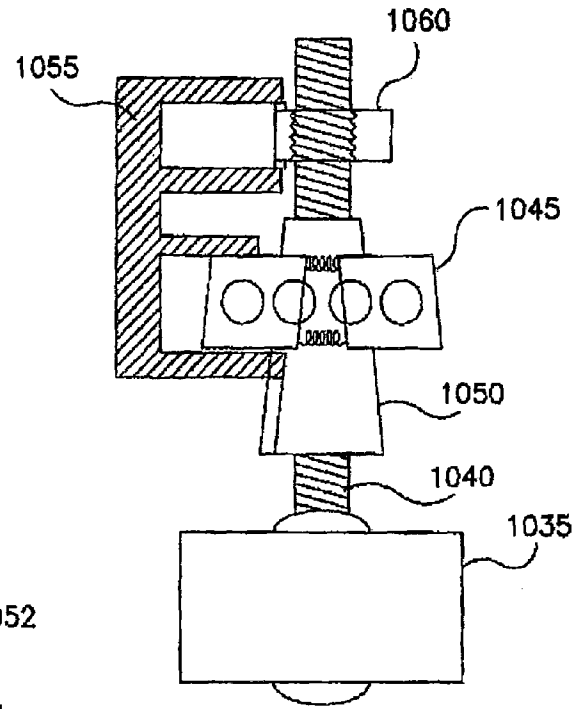
FIG. 56 is a side view of the device of FIG. 55 in use.
Figure 57:
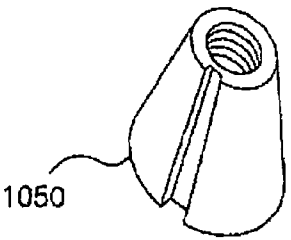
FIG. 57 is a partial view of the device of FIG. 55.
Figure 58:
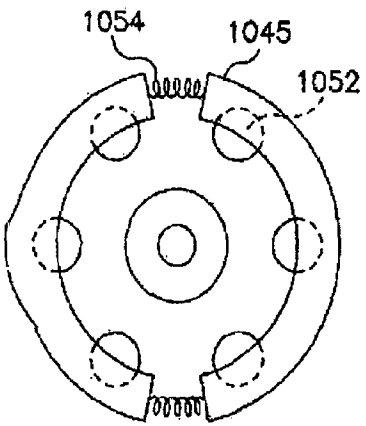
FIG. 58 is a top view of a component of the device of FIG. 55.

Referring now to FIGS. 55-58, there is shown an alternative keyboard tuning mechanism for acoustic string. Referring to FIG. 55, there is shown a tuning element 1030. Step motor 1035 is at its base. The remainder of the mechanism is supported on screw 1040 turned by step motor 1035. A conical threaded shaft element 1050, best seen in FIG. 57, receives and engages screw 1040. A collar 1045, best seen in FIG. 58, is supported on shaft element 1050. Collar 1050 has wheels or bearings 1052 and tensioning springs 1054. Clamp 1055 maintains collar 1045 and nut 1060 stationary. String, 1065 may be precisely adjusted by step motor 1035.

Sensors, impulses, and exciter-coils discussed above are installed in some way on the keyboard under consideration. Let us now assume that the actual frequency of the notes of each string is intended to be according to the standard Equal-Tempered scale. In the absence of a performer or key-strike, the dampers would be raised and the electro-magnets on the individual strings can send a burst of noise into the string. This will, immediately after the impulse ceases, resonate with the string frequency. This can be sensed by the exciting-coil itself, or elsewhere. Regardless, upon receipt of the original exciting signal, there will be servo-adjustment to the string—either in performance or before, in a tuning session. Now assume that this is the starting-state of the piano, but now a defined key-center is transmitted to the decision-circuitry of the Floating Just Temperament system. A new frequency for that note is arrived at, and the servos accordingly adjusted while receiving real-time feedback of sounding-frequency from the string itself. Importantly, if the string is intentionally forced out of tune by expressive devices, the servo will be programmed to cease to attempt to tune and return to estimated normal settings, or remain in stasis. There are many ways to implement this. Electronically, for instance, the frequency-counter would simply look for shifts occurring without a concurrent drive-current to the tuning motor. If this condition were sensed, then the adjustment would be temporarily terminated.

Computer Input/Output Device Implementations

It's important to regard the entire musical keyboard and/or the entire controller assembly described above as data-mining input devices. In the case of a motional feedback system, such as the above-described string-controller, the input device performs feedback that is non-trivial to the data-mining operation. Although musical devices are used to control musical-data in modern synthesis systems, it is non-obvious employ them as I/O devices in the context of a data-mining operation designed to mimic frequency-, timbral- and dynamically-coded operations.

In the simplest realization, a mouse-like device is fitted with a simple one-dimensional velocity- or pressure-sensor. The intensity of the 'mouse-click' forms an interrogation axis superimposed upon the traditionally-employed x-y axis. Refining this concept, the nature of the 'strike' is further interpreted. Pressure or after-touch might be sensed or derived as a separate control function from velocity. The timing of a strike might be meaningful. First, the actual time between strikes might be clocked and a derived control function created—swift strikes might be counted and interpreted differently than fewer or slower strikes, accelerating clicks might be different than decelerating or evenly-spaced clicks. Second, the character of a mouse-click might be examined in the following way: swift clicks arriving at the end of the depression of the 'mouse' (or other) button with no sensed impact force are differently processed than, say, swift clicks arriving with considerable force at the end of the depression. Thus clicks can be interpreted having different meaning depending on the detected force. These two types in turn are analyzed for the duration of that pressure. Thus the 'swift-but-hard/swift' strike would be interpreted differently than the 'swift but hard/long' strike. Significantly, the time-frame for such a differentiated analysis might still be in the milliseconds range. This allows the conceptual and intuitive separation needed to 'derive' a new function called after-touch, although it is not necessarily issued by a discrete sensor. The 'long-term' pressure of after-touch is then, itself, subject to interpretive nuances such as those described above. The two implementations just described need not be processed in isolation. A musical interpretation of the clicks (thus, the concept of a 'chiming' function) will yield yet more nuances within the control signal. Additionally, an array of sensors placed together in the region of the 'mouse' button might be interpreted in any of several ways. Chief of these are the following:

- the location of the attack, combined with the velocity/pressure of the attack creates a unique query structure analogous to the variant timbres produced by various strike positions on a sound-producing object.
- The size and relative distribution of strike velocity/pressure over the area of the striking surface is analyzed to further model the nature of the exciting query.

By the use of one or more of these methods, the familiar 'knock-to-open' action of a mouse-click becomes a nuanced strike—dull and hard and general, soft and specific to the core of a query, or perhaps hard, tiny and specific to the outlying region of a query. By providing, further, audible musical analogues to each query, the user can accurately model the nature of a query.

The modification of the controllers described above, to the specific needs of a given program or interface is possible. The general features, however, described here are identical to the needs of the I/O device. One addition, which is also germane to the musical-synthesis use of the controller is motional feedback. Servos, solenoids, memory-wire and the like might be fitted to the various axes of the assemblies to emulate the physical frictional and inertial characteristics of the system in emulation.

Interactive Tuning Strategies in General

The following will describe a method of temperament for musical instruments that is particularly suited to the generation of computer- or synthesis-based musical composition, storage and performance. This method will be referred to as Floating Just Temperament, or FJT.

In summary, in this tuning methodology, the tuning of an instrument or musical system is non-static and can be made to 'float' between a variety of temperament strategies dynamically—either under the control of a musical performance or composition itself, or under the specific control of a composer or performer. It solves the long-standing problem with keyboard instruments of how to obtain accurate timing of musical intervals without modification to the twelve-key per octave standard or to playing technique. It employs the modern equal-tempered scale as a point of departure and varying the tunings contextually. It employs the natural intervals of the harmonic series as the basis for simple scalar intervals. Each musical interval, such as the major or minor third, is analyzed against a root key or tone. The logic of determining a root key may be an active function derived algorithmically from the musical material performed, an active function of specified elements selected by a composer or performer, such elements including sequenced MIDI data, may be actively or statically specified in advance, or specified by control functions employed by the performer during performance. The intervals played when using floating just temperament are always resolved, if desired. Using this capability, there are no dissonant intervals. Minor seconds and tri-tones are reduced to simple fractions. Simple arithmetic intervals, such as the perfect fifth are allowed to sound with mathematical precision by removals of intentional mistuning used in contemporary tuning practices. It should be noted that there are no fixed pitch values for any given key. Rather, the pitch value is determined by the system in real time. In its most basic implementation the following FJT eliminates the shortcomings of existing temperament systems. The present-day system of equal-temperament evolved over the past three centuries to accommodate the free modulation from musical key to key with the simple arrangement of twelve keys per octave. In practice, several variants were tried, each with a central compromise or limited domain of success. The central reason for this is that each equal-tempered key-center is slightly compromised from its theoretical ideal in order to accommodate the multiple and varied function which each note is called upon to perform uses just temperaments derived from the harmonic content of waveforms themselves, in a shifting pattern of use defined, cybernetically or under user control, by such things as the key-center of the music being played.

FJT can be regarded as employing the techniques of the creation of a virtual keyboard containing many more than twelve interval to the octave, or the creation of a virtual keyboard where each of the traditional twelve notes has multiple virtual alternates, which can be called upon depending upon the function of the particular note in relation to other notes temporally or vertically. It may also be regarded as a system whereby mathematical key-centers and harmonic values can be determined correctly at the request of a composer or performer, and a system which 'blurs the line' between instrument timbre and harmonic structure as compositional and performance tools.

To further expand on explaining FJT as virtual keyboard, the virtual keyboard may be thought of as where each of the traditional twelve notes has multiple virtual alternates, which can be called upon depending upon the function of the particular note in relation to other notes temporally or vertically.

Each of the 12 actual keys has a plurality of virtual keys 'behind' it. The virtual keys represent the written and sounded note of the physical key in every possible slight re-tuning in consideration of musical context. This re-tuning is based upon the numerical multiples of the derived/assumed or player/composer-defined fundamental frequency of the played/sounded musical material which correspond most closely to the traditional equal-tempered frequency of the written/played note.

Electronic Instrument and Musical System Implementations of FJT

In order to apply an appropriate temperament to a musical passage or chordal event, decisions might be made in advance by a composer or performer. Alternatively, a decision-strategy will be employed to actively temper the music in real-time or in post-compositional/improvisational computations.

We will briefly outline the core strategies of Floating Just Temperament tuning. It's important to note that FJT is not simply an indexed series of variant tuning and temperament strategies. In addition to constituting a system by which various temperaments might be recalled when appropriate for the material being composed or performed, the FJT system actively derives temperaments suitable to the physical basis of the sonorities under consideration.

Further, FJT anticipates the establishment of multiple temperaments simultaneously when desirable. Relative harmony (simple numerical relationships) and discord (more complex or irrational numerical relationships) can be intentionally resolved or set in motion against one another within the fully-implemented FJT. Significantly, the temperament system can also be applied to partials rather than fundamentals when partials are, for aesthetic reasons, not simple multiples of the fundamental frequency of a sounded note. This definition can be carried by tags created by the architect of the sound-file or system or, by use of reserved 'write-able' space, by the performer, composer or user. Additionally, this FJT model when applied to musical synthesis, can be used to create a radically-new paradigm for tone-creation.

Floating Just Temperament takes as its baseline temperament any of the contemporary equal-interval systems characterized by slightly mis-tuned intervals considered to be consonant. The equal-temperament system is based upon the twelfth-root of two, or 1.0594631, as the ratio of a semitone. Thus, setting the note 'A' to 220 Hertz, the next semitone above A, that is A#, would be 233.0818808 Hertz, or 220 multiplied by 1.0594631. Any baseline temperament might be employed, but to avoid micro-tonal drifting of key-centers, especially after multiple modulations, the equal-temperament system provides a compromised, but stable frequency-basis for each key-center. To restate, FJT defaults to $12^{th}$ root of 2 semi-tonal intervals derived from A=440 as the native 'at rest' frequencies of its scale. Another way to say it would be that, in an FJT-tuned keyboard, a scale played of single notes alone, with no externally-derived key-center defined, would be composed of accurately-computed $12^{th}$ root of 2 intervals, unless another temperament were desirable for purely aesthetic reasons.

If, however, a chordal interval such as a triad were played, the FJT system would immediately adjust the values of the various intervals in accord with any of several temperament systems. In FJT, unless any of several other mitigating factors are introduced by a composer or performer, the native default strategy would be to employ, by derivation, the equal-tempered scale to a played chord or cluster. In general use the fundamental frequency of the (assumed or indicated) root of the chord would function as the basis for the Just Temperament applied to that chord. In a significant innovation, synthesis and digital processing systems can be set to process equal-tempered signals into just-tempered signals. The basic implementation might be simply the reduction of a waveform into its component (Fourier-derived) harmonic parts. These harmonic elements are then selectively pitch-shifted to conform to the FJT system's frequency centers. First, each waveform (instrument, track, or 'patch') would carry a designation (from the composer, manufacturer/programmer, sound-designer, performer, or mixer) indicating the desirability of perfecting the tuning of partials of each given note of a chord to the FJT partials. The analysis would reveal the presence of fundamentals from which these decisions could be reliably made, even late in the recording/performance cycle. This novel designator may be called the PARTIAL INTEGRITY INDICATOR. This indicator would carry an extension, the PII EXTENSION, which indicates the harmonic (or fundamental) by which to resolve just-temperament. Thus in the case of a bass-note, for example, the second or third partial might be employed to be resolved against other played notes in a chord, rather than the less-audible fundamental. Yet the fundamental could be left unresolved, 'out-of-tune' with the other elements of a chord or cluster. Significantly, the partial chosen for use by the temperament system could be dynamically-defined. Thus a composer, sound-designer, or system architect might allow the chosen strategy to shift in a context-dependent way. This could be done through the use of a look-up table, or by the use of a density tag which could be associated with, or a part of, the PII tag. In practical use, a bass-note, for example, employed in a solo capacity might be tempered to the fundamental, where the same note employed in a dense harmonic structure might be resolved to its second harmonic. Finally, each note or chord, or sonic event, would carry a tag indicating the preferred, key-center of that event together with the indication of the event's 'key-durability'. This unique identifier may be called the KEY DURABILITY TAG. This tag can be a complex item representing note simply fundamental key information, but modes and unusual tunings as well. Also flexible is the depth of decision-making levels accounted for in the durability portion of the tag. A sonic event could be simply labeled as non-durable (meaning no permanent key-center is assigned) or durable (meaning that no event undermines or reassigns the original key). Conversely, nuanced situations of use could be expressed by this durability factor. For instance—the note-value of the key is durable, but the mode (say major or harmonic minor) is set by surrounding musical events. These are unique concepts new to FJT.

This derivation would follow this assumption:

If enharmonicity is not an intentional factor employed for aesthetic reasons, we can assume that the series of partials ensuing from a fundamental is a direct additive process derived from the frequency of the fundamental-, or root-tone of a given harmonic cluster or chord. In the case of the note A=220, the harmonic series would be as follows:

| | | |
|---|---|---|
| $2^{nd}$ harmonic | 440 Hz | octave |
| $3^{rd}$ harmonic | 660 Hz | octave + fifth |
| $4^{th}$ harmonic | 880 Hz | two octaves |
| $5^{th}$ harmonic | 1100 Hz | two octaves + third |
| $6^{th}$ harmonic | 1320 Hz | two octaves + fifth |
| $7^{th}$ harmonic | 1540 Hz | two octaves + dom $7^{th}$ |
| $8^{th}$ harmonic | 1760 Hz | three octaves |
| $9^{th}$ harmonic | 1980 Hz | three octaves + $2^{nd}$ |
| $10^{th}$ harmonic | 2200 Hz | three octaves + $3^{rd}$ complex[1] |

[1]The designation 'complex' will be discussed elsewhere in greater detail as part of the theory of note-continuum. There are clusters of arithmetically-valid intervals clustered around musically-useful intervals such as the third.

It's evident that if the natural overtone series were continued through six octaves, even the most complex scalar intervals could be derived from the natural harmonics. While these pitches are well-known, the concept of dynamically-scaling to them is new. In fact, by the fourth octave above the fundamental pitch, every normal interval is present in the overtone structure, and some unusual, but consonant, intervals as well. Where F is the fundamental frequency, if we take 16F as the starting point of a just-tempered octave, the following relationships emerge:

16F/16=root 1.0
17F/16=minor second 1.0625
18F/16=major second 1.125
19F/16=minor third 1.1875
20F/16=major third and so on . . .
22F/16=fourth
23F/16=tritone #$4^{th}$
24F/16=fifth
25F/16+#$5^{th}$
26F/16=sixth
28F/16=flat seventh
is 30F/16=major seventh
32F/16=octave Notice that the interval between notes is slightly larger than the interval of the equal-tempered system—from 1.05946 to 1.0625. However, the intervals of 21/16, 27/16, 29/16 and 31/16 are missing in this scale system. The missing intervals allow the scale to return to even multiples at the octave. The missing intervals are musically useful and are part of a continuum that, as we'11 see, resolves enharmonic intervals in a unique continuum of pitch. Examining the intervals at a finer level of resolution, we move up to a partial series of the fifth and sixth octave. Here we find some interesting intervals:

42/64=major third continuum (21/32)
54/64=sixth continuum (27/32)
58/64=dominant seventh continuum (29/32)
62/64=major seventh continuum (31/32)

Notice that these consonant, but more complex, intervals fill in the gaps of the lower-octave-derived scale. Notice, too, that each has an irreducible fraction to each side of it. These allowed intervals, combined with their adjacent intervals, and the continuum intervals above, form a pitch-continuum around the interval of the third and the seventh, and also of the sixth. The pitch-continuum concept will be discussed elsewhere.

In a significant innovation of FJT it is possible to define an entire temperament for a piece of music as a global event. This pitch being capable of floating throughout a composition or performance, such fixity or drift is capable of definition by a performer/composer or algorithmically. It is also possible to define multiple key-centers as isolated and co-existent global events. Significantly, any of these global events can be 'stretched' to employ a complex numerical resolution. This would typically cause harmonics to become slowly flatter or sharper than the perfect numerical multiples of their fundamental frequencies. While these effects could be created through the use of look-up tables, they also can be created by weighting factors that simulate deviations typical of acoustic instruments. In these instruments, the deviation of partials from the predicted values follows simple rules related to the diameter, mass, elasticity and other characteristics of the sounded medium. One may set aside tagging-space for the purpose of allowing such altered or 'stretched' math to form the basis of a global temperament scheme to which some, or all, of the elements of a performance, patch, or composition could be made to conform.

MIDI and Other Implementation Schemes

Although various strategies might be employed to accommodate the additional data associated with FJT, the current ubiquity of MIDI makes it a convenient platform for the implementation of FJT. In the simplest implementation an entirely separate MIDI channel could be dedicated to each voice, patch, or section of a composition or performance. In fact in works not employing the multiple simultaneous key-centers possible with FJT, which at the present time would be the preponderance of uses, a single dedicated channel would suffice for an entire piece. Again, in the simplest use, a played or derived, but not sounded, note on such a 'phantom' data channel would define the key tonic of the sounded music. This data could be routed from an algorithmic key-center logic or by a human performer/programmer. In the case of purely algorithmic key determination, the use of MIDI is not required since the temperament information could be generated within a synthesizer or DAW (Digital Audio Workstation). Within the MIDI open spec exist many opportunities to elaborately define key information. The MIDI standard accommodates multiple octave of note information. Each note carries velocity and duration information, as well as the potential for timing information for each note's 'on-time' relative to a master clock. All of this rich data can be employed to define temperament data. If, say, each octave defined a given temperament center, it could be pre-mapped that each ascending (for instance) octave (of MIDI signal, for example) referenced a distinct voice or section requiring discrete temperament information. We might re-purpose the velocity data so that it defines temperament strategies in more detail. A module might be provided to impose or mix this data with the note-data by overriding the actual velocity data of a phantom 'key-center' performance and replacing it with selected additional. Assuming 128 states of velocity, we could define the states something like this:

001 major FJT temperament/ of fundamental
002 melodic minor FJT/ of fundamental
003 harmonic minor FJT/ of fundamental
004 etc.
010 major FJT temperament/ of second harmonic
011 melodic minor FJT/ of second harmonic
012 harmonic minor FJT/ of second harmonic
013 etc.
020 major FJT temperament. Of third harmonic
021 etc.
080-100 various strategies including Pythagorean, microtonal and other existing temperament strategies
101-128 user-defined strategies The sounded note in a given octave would define the actual key-center and the velocity information would thus define the actual fine-tunings with the harmonic structure of the sounded notes. By allowing note-on or off data to skew from the actual sounded track by a small number of clicks/ticks, additional data might be hidden in the stream without compromising the integrity of a performance. Thus, for instance, dynamic decisions regarding which octave of overtones (or fundamental) should be the focus of the temperament's work (important when there is drift between the perfect multiples-of-fundamental-frequency harmonics and the actual harmonics). When data arrives zero-clicks ahead of note-on data (on the relevant MIDI-channel) for instance, this might encode the (default) use of the fundamental. If data arrived one-click ahead this might indicate the first partial ($2^{nd}$ harmonic) as the focus of re-temperament, and so on. Additionally, MIDI specification defines several 'controller' tracks which might similarly be re-purposed. It's significant to note that for a given voice to operate without additional MIDI data-bearing, non-sounding, tracks to be dedicated to the purpose there are other strategies. One is to commandeer controller tracks and similarly re-purpose the data stream. One controller might encode key-centers, another deviant temperament strategies, and another harmonic data, and so on. Another strategy would be to break up the 128-states of one or more controller streams into small block of as few as 2 bits, which would allow four states per note, thus accommodating thirty-two unique notes in a single controller stream. Similarly, or simultaneously, an unused portion of the note-data itself—for example, the highest-octave notes—could be used to hold non-sounded data. If this were done, then a blanking protocol may be employed that would simply test for the presence of FJT software/hardware and if not present strip-away such 'top-octave' data before playing a MIDI file. The general form of such a test is to cause any FJT MIDI file to be so marked with a characteristic opening-pattern of controller data (for instance a simultaneous stream of ascending primes on two (non-sounding) controller channels). Hardware or software would be configured to recognize and wait a few milliseconds upon receipt of such a stream and to issues a command to mine the FJT data from a proprietary/dedicated file attached to the standard MIDI performance and to insert it into the MIDI records before playing such a record. The possible permutations are numerous.

Another innovation possible with FJT-elements is unrelated to the resolution of inter-note consonances, although it can be employed with or without the attendant use of temperament strategies. Here we introduce the concept of phantom melodies and phantom bass-movement, as well as phantom modulation. These phenomena are linked by the use of an unheard control track to alter the contents of separate 'sounded' musical elements. When a phantom key-center chance is introduced, without a change in the sounded notes, a subtle re-tuning of the fundamentals and/or the harmonics of those notes occurs thus giving rise to audible phantom-modulations. Holding a C-minor triad for instance while moving the phantom note, defined as a phantom-modulator, to various key-centers, say C, E-flat, A-flat will create dramatically, but subtle, re-definitions of the musical/harmonic relationships of the notes of that triad. The described modulation function of the phantom note information is the default value for that information. It is important to state that, while bass-motion can be employed to define key-centers, and even that bass-movement can be algorithmically evaluated to detect shifting key-centers with some reliability, that bass-movement in itself is different from the FJT definition (by variable) of a key center. When an FJT-defined key center moves without concurrent and identical audible bass-motion, said FJT bass-motion would be defined as 'phantom'. Phantom melodic motion is a special case. In sophisticated realizations of the FJT system of tuning, it may be desirable to shift the fundamentals and/or partials of sounded material to reflect a non-sounded melody and thus render it audible. The theory behind this is derived from a subtractive white-noise musical model. For clarity, let's examine an exemplary compound use of FJT in action. A series of chords are played in the harmonic-minor key of the fundamental of the opening chord (say Cm) which are intended to be background material in a homophonic musical texture. The chords have an audible bass-motion which shifts from the tonic to the minor third in a half-note pattern (say C to E-flat), or twice within each measure of 4/4 time. The phantom bass-motion, however, defines the chords as remaining in the tonic key (Cm) for four bars and then modulating to the fourth-degree (F) for four bars. Thus the fundamentals of the sounded chords are tempered by the two key centers defined by the phantom FJT bass, and shift appropriately each four bars. The result is that, although the listener hears only a repeating chordal movement with a C to E-flat bass-movement, the temperament is adjusted to cause a phantom motion within this pattern of C to F. This subtle re-tuning is heard as a phantom bass-motion below the sounded bass. If it were desirable to accentuate this illusion, then the harmonics of the phantom note would be duplicated in all, or some of, the harmonics of the sounded notes. If only the fundamentals of the sounded notes are tempered to reflect the phantom motion of the bass and the overtones of the sounded notes were left as they were defined by the sounded 'voices' themselves. Now let us posit the addition of a non-sounding phantom melody. This melody can be heard through the presence of its partials and/or fundamentals as it moves through the homophonic texture described above. In a fully-realized FJT system, the fundamental frequencies of the sounded notes might remain in obedient temperament to the phantom key-centers defined by the bass, while the partials of the sounded notes were 'bent' slightly to equal the theoretical values of the phantom melody passing over or through them. The degree of this alteration, its volume and frequency-bandwidth relative to the rest of the sounded material and even the presence or absence (and at what level) of the unaltered harmonics of the background material. These interactions are defined by the tags of the system and by the interaction of other existing musical parameters. The volume of the phantom melody as defined by its played (MIDI) record and/or its volume in a final mix, might define the strength of its interaction with the sounded material. The result, though, is to make audible the inaudible as a creative performance and composing tool. In summary, this aspect of the invention is the method of providing a melody, harmony, bass-motion or sonic-event heard entirely through the interplay of the harmonic data from other, sounded, voices, and a system adapted to create this effect.

In the event of say, a phantom percussive event, FJT proposes to, first, alter the pitch-centers of the sounded notes and, second, to widen the theoretical resonance of the fundamental and partials of the sounded notes to add adjacent-frequencies to them which are demanded by the phantom note. The methods and decision-matrices must be developed to implement this. In this system, notes, data-points, concepts, and so forth, are regarded in general to be statistical events arising, through a greater or lesser resonant excitation, out of a field of inaudibly (insignificant) low-level white noise. Second, because of the rigorous and multi-dimensional definition of the harmonic structure of sonic event required by FJT-based synthesis, that it is possible to create mathematical models of theoretical harmonic data not present or detectable in the sounded material that allow the (re-)creation of missing/non-existent harmonic material.

Acoustic Instrument Implementations of FJT

In an acoustic instrument FJT can be implemented post-facto by causing a re-tuning strategy to be performed upon the instrument after it is recorded or otherwise mic'ed and converted into an electrical signal within an effect-box or DAW. The re-tuning is algorithmic in nature so it will not be explored here. In the case of a mechanically-altered instrument the choice of FJT key-center decisions might be made manually by a performer (perhaps on a second 'key-center keyboard' device) or algorithmically. However temperament decisions are made the following methods are among those that might be employed to realize real-time re-tuning of an acoustic instrument. We will limit or discussions to a keyboard device, but the principles might be applied to any acoustic sound-generating device.

Each tuning-peg of a keyboard or stringed instrument could be equipped, through various reduction gears, with a servo-motor. The pitch of the string would be read by a transducer and the appropriate micro-tonal adjustments applied in real-time to the string tension. Obviously this could be done in advance of a specific performance as well. There are clearly other strategies, such as the motion of bridges and saddles that lengthen or shorten a string that might be equally effective. In either case, the string pitch might be directly sensed by the vibration of the saddle or tuning pin itself in a variety of ways. Further, a servo-tuning mechanism itself might be employed simply for the maintenance of optimal traditional or altered tunings. These uses, and specific implementations of them, were described, elsewhere, in detail.

Data-Mining Uses of FJT Principles

The use of the principles of Floating Just Temperament specifically, and of complex musical analogues in the mining of information has profound implications. The use of a fundamental and harmonic model could be used with a future absolute and general taxonomy, it is easily deployed with any existing taxonomy. With each assignment of values to harmonic and dynamic characteristics of physical vibrational models, novelty is generated. The character of that novelty is altered by the congruence of the underlying assumptions of a particular taxonomic system with the absolute physical characteristics of a vibrational and emotionally-nuanced query-model.

Specifically, as the key-centers and the nature of the deployment of, and mathematical basis for, generated harmonics is dynamically focussed on a complex query, the locus of the underlying data and the mining-assumptions shifts. The shift may be toward a subtle underlying characteristic of the query, or it may be to a remote inter-relational characteristic shared by query-terms. This fact alone, even divorced from the nuanced layers possible with a fully-articulated query, is the potential source of great insight and novel points-of-view.

Silent Keys and Virtual Bowing and the Like

The keys of a musical keyboard, including keys equipped with physically-mobile, or emulated-motion, keys allowing the keys to be pulled toward and pushed away from the performer (or sensed by pressure, strain or other methods in the key, or by motion or position in the key or key-top) be selectively made to be silent upon depression until a selected movement is made or emulated by the performer. In particular, the instrument will remain silent until the bowing movement is emulated/imitated by the performer using the analog of bowing motions made by drawing the playing fingers towards or away from oneself while performing. This can be done through many methods. In an exemplary implementation, a string patch is selected. This sets the sounding volume to zero regardless of the pressure of depression. It is also desirable to make some arbitrary volume, pressure and/or velocity parameter create an on-set voltage in emulation of, for example, a marcato effect. The threshold might be, say, 95 out of 127 MIDI volume levels. More sophisticated algorithms could also be employed such as are anticipated in the three-tier control vector discussion elsewhere. Having set the patch thus, the key-tops for example could detect broad flats of fingertip profiles (that is fingers contacting the keys nearly parallel to the key-tops) and assign these the legato-bowing control characteristics, while small fingertip profiles such as made by distinctly perpendicular key-strikes might be assigned, for example a col legno control profile.

Likewise, any other controller described above, or volume-timbral-parametric shift desired might also be made the subject of this method.

Momentary Lift, or Other Defined Key Motion, Sets Control Parameters

It is a general character of the mediating system that brief upward motions of a key, or any other brief control motion that can be reliably defined and differentiated from other gestures or control signals in simultaneous use, can be defined to set other parameters than those defined by the same control signal in a longer duration. For example, the base-key used for the computation of keys centers in FJT, might be defined by the brief upward lifting of any key. Such differentiated control signals that are defined as global or semi-global in nature (that is, not associated with the specific key operated, except that the operated key is used to set a specific (global) parameter) might be spatially associated with the control-key operated. Thus, if it were so defined in advance, a separate FJT key-center, for example, might be set for actions in a particular area of the keyboard simultaneously and semi-globally. A key lifted in the general range of left hand play might therefore set a parameter only for the actual or projected actions of that hand. Simultaneously, a semi-global command might be issued for the right hand—by, say, lifting a single key briefly. The momentary lifting of two or more keys simultaneously could be defined so as to compute a compound FJT harmonic series. Say C and an E-flat were simultaneously lifted, even in spatially remote areas of the keyboard, the lower one, say C, might be default-set to form the bass, or fundamental, note of a harmonic series while the upper, say E-flat, might indicate that the sounded notes following such a control setting be justified to a harmonic series higher in the partial-row, thus, in this example, by-passing the second octave of harmonics that would resolve a, say, sounded E-natural to the low 'E' present in the second octave of partials. This is by way of example only.

Where sensors are referred to in this application, it will be understood that such sensor may include, as appropriate, strain and forces sensors (SFS), optical sensors, thermocouples, load cells, motion detectors, pressure sensors, magnetic field sensors, accelerometers, temperature probes, and relative humidity sensors.

While the invention has been described with respect to specific articles, methods and systems, the invention is not limited to any particular embodiment, and variations within the scope and spirit of the invention will be evident to those of skill in the art.

What is claimed is:

1. A piano having:

(a) a plurality of strings;

(b) a musical keyboard, comprising a plurality of keys, each of said keys being mechanically coupled with one of said strings and mounted to rotate to a normal striking position for striking the mechanically coupled one of said strings and in the same direction beyond the normal striking position to an extreme striking position; and (c) a plurality of sensors, one of said sensors being positioned with respect to each of said keys to be contacted by said key in said extreme striking position only, for providing effects.

2. A keyboard musical instrument having a keyboard, a plurality of keys in said keyboard, a string associated with each of said keys, and an electromagnet associated with each of said strings and able to adjust characteristics of vibrations of said strings by interaction between said strings and fields emitted by said electromagnets.

3. A method for providing music employing a keyboard musical instrument having a keyboard, a plurality of keys in said keyboard, a string associated with each of said keys, comprising the step of employing magnets to dampen or enhance the fundamental or one or more harmonics of at least one of said strings by interaction between said at least one string and fields emitted by said magnets.

* * * * *